US009520067B2

(12) United States Patent
Teramoto et al.

(10) Patent No.: US 9,520,067 B2
(45) Date of Patent: Dec. 13, 2016

(54) AIR TRAFFIC CONTROL ASSISTANCE SYSTEM, AIR TRAFFIC CONTROL ASSISTANCE METHOD, AND STORAGE MEDIUM

(71) Applicant: NEC Corporation, Tokyo (JP)

(72) Inventors: Sachio Teramoto, Tokyo (JP); Tomohito Ando, Tokyo (JP); Hiroki Tagato, Tokyo (JP); Koji Kida, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 14/780,867

(22) PCT Filed: Mar. 27, 2014

(86) PCT No.: PCT/JP2014/001795
§ 371 (c)(1),
(2) Date: Sep. 28, 2015

(87) PCT Pub. No.: WO2014/156169
PCT Pub. Date: Oct. 2, 2014

(65) Prior Publication Data

US 2016/0042647 A1 Feb. 11, 2016

(30) Foreign Application Priority Data

Mar. 29, 2013 (JP) ..... 2013-072179

(51) Int. Cl.
*G08G 5/04* (2006.01)
*G08G 5/00* (2006.01)

(52) U.S. Cl.
CPC ..... *G08G 5/045* (2013.01); *G08G 5/0026* (2013.01); *G08G 5/0043* (2013.01); *G08G 5/0082* (2013.01)

(58) Field of Classification Search
CPC ..... G08G 5/0026; G08G 5/045; G08G 5/0043
See application file for complete search history.

(56) References Cited

U.S. PATENT DOCUMENTS 5,058,024 A 10/1991 Inselberg
6,195,609 B1 * 2/2001 Pilley ..... G01C 23/00 342/36

(Continued)

FOREIGN PATENT DOCUMENTS

EP 0380460 A2 8/1990
EP 1020834 A2 7/2000

(Continued)

OTHER PUBLICATIONS

International Search Report corresponding to PCT/JP2014/001795, mail date Jun. 17, 2014, 3 pages.

*Primary Examiner* — Yuen Wong
(74) *Attorney, Agent, or Firm* — Wilmer Cutler Pickering Hale and Dorr LLP

(57) ABSTRACT

Provided is an air traffic control assistance system whereby it is possible to display the reliability of an avoidance recommendation over time in a manner which is easily understood by an air traffic controller. For each combination of link information of an aircraft of interest and link information of an aircraft in the vicinity thereof, a graphic identification unit identifies a graphic which represents a prescribed range which is defined by the aircraft in the vicinity thereof, in a plane which includes a three-dimensional vector which is represented by the link information of the aircraft of interest and which is perpendicular to the x-y plane. When transforming a two-dimensional vector in an x-y plane from one fix of the aircraft of interest to the next fix to align in order along the x-axis, a transform matrix computation unit computes, for each two-dimensional vector, a transform matrix which represents a transform from a (Continued)

plane which contains the two-dimensional vector and is perpendicular to the x-y plane to a plane which is defined by the x-axis and a time axis. A display processing unit transforms the graphic, and displays a line which joins the fix and a point which is determined by the time whereat the aircraft of interest transects the fix, and the transformed graphic.

5 Claims, 9 Drawing Sheets

(56) References Cited

U.S. PATENT DOCUMENTS

| | | | |
|---|---|---|---|
| 2002/0135467 | A1 | 9/2002 | Koike |
| 2003/0006889 | A1 | 1/2003 | Koike |
| 2003/0009275 | A1 | 1/2003 | Koike |
| 2009/0024357 | A1 | 1/2009 | Aso et al. |
| 2012/0316773 | A1 | 12/2012 | Sukenari |

FOREIGN PATENT DOCUMENTS

| | | | |
|---|---|---|---|
| EP | 1435601 | A2 | 7/2004 |
| EP | 1990786 | A1 | 11/2008 |
| JP | 02-230500 | | 9/1990 |
| JP | 06-168026 | | 6/1994 |
| JP | 2000-276696 | A | 10/2000 |
| JP | 2000-276700 | A | 10/2000 |
| JP | 2012-118697 | A | 6/2012 |
| JP | 2012-203593 | A | 10/2012 |
| WO | WO-2007/102367 | A1 | 9/2007 |
| WO | WO-2011/114635 | A1 | 9/2011 |

* cited by examiner

AIR TRAFFIC CONTROL ASSISTANCE SYSTEM, AIR TRAFFIC CONTROL ASSISTANCE METHOD, AND STORAGE MEDIUM

CROSS-REFERENCE TO RELATED APPLICATIONS

This application is a national stage application of International Application No. PCT/JP2014/001795 entitled "AIR TRAFFIC CONTROL ASSISTANCE SYSTEM, AIR TRAFFIC CONTROL ASSISTANCE METHOD, AND AIR TRAFFIC CONTROL ASSISTANCE PROGRAM," filed on Mar. 27, 2014, which claims the benefit of the priority of Japanese Patent Application No. JP2013-072179, filed on Mar. 29, 2013, the disclosures of each of which are hereby incorporated by reference in their entirety.

TECHNICAL FIELD

The present invention relates to an air traffic control assistance system, an air traffic control assistance method, and a storage medium assisting air traffic controllers by displaying states of aircraft in the case of assuming that a conflict avoidance proposal is employed.

BACKGROUND ART

In recent years, in some cases, the air traffic amount is increasing and a near miss (conflict) between aircrafts occurs. A conflict is a state that two aircrafts travelling at the same altitude approach more closely than a distance set to assure safety (oceanic air traffic control separation).

In the case that occurrence of a conflict is detected in advance, an avoidance proposal of changing the state of an aircraft is generated in order to avoid the conflict. The generation of the avoidance proposal is not limited to one. An air traffic controller selects an avoidance proposal and instructs the aircraft in accordance with the avoidance proposal. One avoidance proposal indicates a change in speed or altitude of one aircraft. Therefore, it can be said that one avoidance proposal corresponds to one aircraft.

Various devices for assisting an air traffic controller have been proposed (for example, refer to patent literature 1 and 2). A device described in PTL 1 generates an avoidance proposal to avoid a conflict and displays respective avoidance proposals in order based on priorities of the avoidance proposals.

A system described in PTL 2 extracts aircrafts existing in a predetermined range and three-dimensionally displays the aircrafts.

CITATION LIST

Patent Literature

PTL 1: Japanese Unexamined Patent Application Publication No. 2012-118697 (paragraphs 0027, 0030 to 0033, and the like)

PTL 2: Japanese Unexamined Patent Application Publication No. 2000-276700 (page 1, paragraph 0058, FIG. 4, and the like)

SUMMARY OF INVENTION

Technical Problem

It is assumed that a conflict is detected in advance and a plurality of avoidance proposals for avoiding occurrence of the conflict are generated. In this case, an air traffic controller has to select one of the avoidance proposals and give an instruction according to the avoidance proposal. However, even if the conflict is avoided by the avoidance proposal selected by the air traffic controller, as a result of changing the state of the aircraft, another conflict may occur in future. When another conflict is detected in the future as a result of employing the avoidance proposal for avoiding the conflict, the air traffic controller has to select an avoidance proposal again. Consequently, in the case where an air traffic controller selects an avoidance proposal and gives an instruction to an aircraft corresponding to the avoidance proposal, it is preferable that the air traffic controller can easily determine the number of other aircrafts approaching the aircraft in the future. The number of other aircrafts approaching the aircraft corresponding to the avoidance proposal in the future expresses reliability of the avoidance proposal at present and in the future. Specifically, it can be said that the smaller the other aircraft approaching the aircraft corresponding to the avoidance proposal in the future is, the higher the reliability of the avoidance proposal is, and the larger the other aircraft approaching the aircraft in the future is, the lower the reliability of the avoidance proposal is.

A device described in PTL 1 displays avoidance proposals in order based on priority of the avoidance proposals. The priority is, however, determined by a standard different from the number of other aircrafts approaching an aircraft corresponding to an avoidance proposal in the future.

A system described in PTL 2 three-dimensionally displays aircrafts existing in a predetermined range. The display result indicates a congestion state of aircraft at a certain time point. Therefore, in the case where an air traffic controller tries to grasp a congestion state in the future, he/she has to designate a certain time point in the future and check a result of three-dimensional display at that time point. In addition, the air traffic controller can grasp only a congestion state at a certain time point in the future. Consequently, when an air traffic controller tries to grasp a congestion state in a time zone from the present to future, the air traffic controller has to designate respective times in the future and check three-dimensional display results. Therefore, the load on the air traffic controller becomes heavy.

An object of the present invention is therefore to provide an air traffic control assistance system, an air traffic control assistance method, and an air traffic control assistance program capable of displaying reliability of an avoidance proposal at present and in the future in a mode that an air traffic controller can easily understand.

Solution to Problem

An air traffic control assistance system according to the present invention includes: figure specifying means which determines, as a set of interval information between passing points of a moving object expressed by a set of three-dimensional coordinates using, as coordinate values, an x coordinate and a y coordinate of a passing point determined as a position where the moving object passes and passing time of the moving object, a set of interval information of an aircraft of interest as one of moving objects in the case where the state of the aircraft of interest as a moving object as a target of a state change by an avoidance proposal for a near miss between the moving objects is changed on the basis of the avoidance proposal and interval information of an aircraft in vicinity as one of the moving objects other than the aircraft of interest, and specifies a figure expressing a predetermined range defined by the aircraft in vicinity in a plane including a three-dimensional vector expressed by the interval information of the aircraft of interest and perpendicular to an xy plane for each of sets of the interval information of the aircraft of interest and the interval information of the aircraft in vicinity, transformation matrix calculating means which calculates, for each two-dimensional vector, a transformation matrix expressing a transformation from a plane including the two-dimensional vector and perpendicular to the xy plane to a plane defined by the x axis and the time axis in the case of transforming two-dimensional vectors in the xy plane extending from a passing point of the aircraft of interest toward a next passing point so as to be arranged in order along the x axis, and display processing means which applies, to the figure specified by the figure specifying means, a transformation matrix corresponding to the interval information of the aircraft of interest used to specify the figure, transforms the figure to the plane defined by the x axis and the time axis, and displays a line connecting points each determined by a passing point and time when the aircraft of interest passes through the passing point and the transformed figure together with the x axis and the time axis.

An air traffic control assistance method according to the present invention includes the steps of: determining, as a set of interval information between passing points of a moving object expressed by a set of three-dimensional coordinates using, as coordinate values, an x coordinate and a y coordinate of a passing point determined as a position where the moving object passes and passing time of the moving object, a set of interval information of an aircraft of interest in the case where the state of the aircraft of interest as a moving object as a target of a state change by an avoidance proposal for a near miss between moving objects is changed on the basis of the avoidance proposal and interval information of an aircraft in vicinity as one of the moving objects other than the aircraft of interest, and specifying a figure expressing a predetermined range defined by the aircraft in vicinity in a plane including a three-dimensional vector expressed by the interval information of the aircraft of interest and perpendicular to an xy plane for each of sets of the interval information of the aircraft of interest and the interval information of the aircraft in vicinity, calculating, for each two-dimensional vector, a transformation matrix expressing a transformation from a plane including the two-dimensional vector and perpendicular to the xy plane to a plane defined by the x axis and the time axis in the case of transforming two-dimensional vectors in the xy plane extending from a passing point of the aircraft of interest toward a next passing point so as to be arranged in order along the x axis, and applying, to the specified figure, a transformation matrix corresponding to the interval information of the aircraft of interest used to specify the figure, thereby transforming the figure to the plane defined by the x axis and the time axis, and displaying a line connecting points each determined by a passing point and time when the aircraft of interest passes through the passing point and the transformed figure together with the x axis and the time axis.

An air traffic control assistance program according to the present invention makes a computer execute: a figure specifying process which determines, as a set of interval information between passing points of a moving object expressed by a set of three-dimensional coordinates using, as coordinate values, an x coordinate and a y coordinate of a passing point determined as a position where the moving object passes and passing time of the moving object, a set of interval information of an aircraft of interest as one of moving objects in the case where the state of the aircraft of interest as a moving object as a target of a state change by an avoidance proposal for a near miss between the moving objects is changed on the basis of the avoidance proposal and interval information of an aircraft in vicinity as one of the moving objects other than the aircraft of interest, and specifies a figure expressing a predetermined range defined by the aircraft in vicinity in a plane including a three-dimensional vector expressed by the interval information of the aircraft of interest and perpendicular to an xy plane for each of sets of the interval information of the aircraft of interest and the interval information of the aircraft in vicinity, a transformation matrix calculating process which calculates, for each two-dimensional vector, a transformation matrix expressing a transformation from a plane including the two-dimensional vector and perpendicular to the xy plane to a plane defined by the x axis and the time axis in the case of transforming two-dimensional vectors in the xy plane extending from a passing point of the aircraft of interest toward a next passing point so as to be arranged in order along the x axis; and a display process which applies, to the figure specified by the figure specifying process, a transformation matrix corresponding to the interval information of the aircraft of interest used to specify the figure, transforms the figure to the plane defined by the x axis and the time axis, and displays a line connecting points each determined by a passing point and time when the aircraft of interest passes through the passing point and the transformed figure together with the x axis and the time axis.

Advantageous Effects of Invention

According to the present invention, reliability of an avoidance proposal at present and in the future can be displayed in a mode that an air traffic controller can easily understand.

DESCRIPTION OF EMBODIMENTS

First, terms to be used for description of the present invention will be described.

A "flight plan" is a transit plan determined for each aircraft. A flight plan of one aircraft is expressed as a set of combinations of position coordinates of a predetermined passing point and time when the aircraft passes through the passing point. The position coordinates of a passing point are an x coordinate and a y coordinate in a map expressed two-dimensionally. Therefore, a flight plan is expressed by a set of combinations of three values of (x coordinate, y coordinate, time).

A "FIX" denotes a passing point of an aircraft indicated by a flight plan. In the above-described combination of the three values of (x coordinate, y coordinate, time), the x and y coordinates express the position of an FIX.

Information of an interval of a pair of FIXs neighboring in passing order of one aircraft will be described as a "link." A link is expressed by a combination of (x coordinate, y coordinate, time) of a FIX on earlier passing time of the aircraft and (x coordinate, y coordinate, time) of a FIX on later passing time of the aircraft. A link can be expressed as a vector in three-dimensional space. In a pair of FIXs neighboring in passing time order, (x coordinate, y coordinate, time) of the FIX on earlier passing time is the start point of the link. In the pair of FIXs neighboring in passing time order, (x coordinate, y coordinate, time) of the FIX on later passing time is the end point of the link.

Hereinbelow, time (passing time of an aircraft) is expressed as a coordinate of a t axis perpendicular to the x axis and the y axis.

Figure 1:
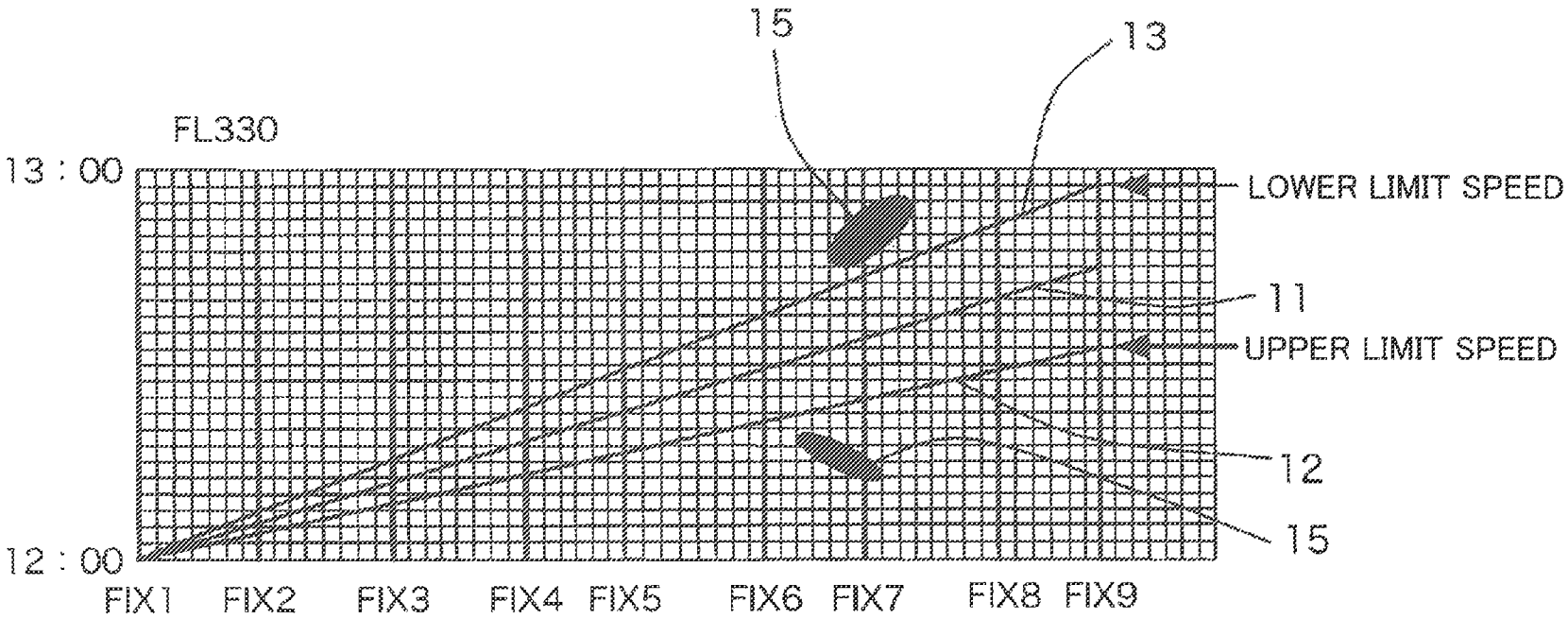
FIG. 1 is an explanatory diagram illustrating an example of an output screen of an air traffic control assistance system of the present invention.

Next, an example of an output screen in the present invention will be described. FIG. 1 is an explanatory diagram illustrating an example of an output screen of an air traffic control assistance system of the present invention. The horizontal axis illustrated in FIG. 1 expresses sequence of FIXs in order of passing time of an aircraft. The vertical axis illustrated in FIG. 1 expresses time. The interval between FIXs shown on the horizontal axis expresses the distance between the FIXs.

To the air traffic control assistance system of the present invention, at least a flight plan of each aircraft and an avoidance proposal selected by an air traffic controller are input. The air traffic control assistance system of the present invention displays a graph (refer to FIG. 1) using FIXs determined by a flight plan of an aircraft corresponding to the avoidance proposal on the horizontal axis and using time on the vertical axis.

The air traffic assistance system specifies, on the graph, time when an aircraft corresponding to the avoidance proposal passes each of the FIXs in the case of changing the state of the aircraft in accordance with the avoidance proposal and also displays a line 11 connecting points expressing the passing time of the FIXs. The line will be described as a reference line 11. Hereinbelow, the aircraft corresponding to the avoidance proposal will be described as an aircraft of interest. All of aircrafts other than the aircraft of interest will be described as aircrafts in vicinity.

The avoidance proposal expresses a change in speed or altitude of an aircraft of interest. It is assumed that each of the FIXs the aircraft of interest passes is not changed. That is, it is assumed that the route of the aircraft of interest is not changed.

The air traffic control assistance system may also display a line 12 connecting points expressing passing time of the FIXs in the case where the aircraft of interest travels at legal upper limit speed and a line 13 connecting points expressing passing time of the FIXs in the case where the aircraft of interest travels at legal lower limit speed.

Each of ellipses 15 illustrated in FIG. 1 expresses a proximity state between the aircraft of interest and an aircraft in vicinity. One ellipse corresponds to one aircraft in vicinity. It indicates that the closer the ellipse 15 to the reference line is, the more the aircraft in vicinity approaches the aircraft of interest. Intersection of the ellipse 15 and the reference line 11 means that, even if, for example, speed is changed along an avoidance proposal, a conflict occurs in the future. Therefore, an air traffic controller can determine occurrence probability of a conflict after performing an air traffic control along an avoidance proposal in accordance with the number of the ellipses 15 and the distance between the ellipse 15 and the reference line 11. The smaller the number of the ellipses 15 is, the more it is preferable. The more the ellipse 15 is apart from the reference line 11, the more it is preferable. In the vertical axis illustrated in FIG. 1, a time zone corresponding to the ellipse 15 is a time zone in which an aircraft in vicinity passes the same position as the aircraft of interest.

Hereinbelow, exemplary embodiments of the present invention will be described with reference to the drawings.

First Exemplary Embodiment

In the present invention, it is assumed that a conflict is detected in advance and a plurality of avoidance proposals for the conflict are generated. For example, an external system (not illustrated) of an air traffic control assistance system of the present invention may detect a conflict and generate a plurality of avoidance proposals for the conflict. An air traffic controller selects one of the plurality of avoidance proposals generated and inputs it to the air traffic control assistance system of the present invention. The selection of the avoidance proposal denotes a selection intended that an air traffic controller checks the graph illustrated in FIG. 1 and grasps the reliability of the avoidance proposal at present and in the future, but does not denote a selection intended to immediately employ the avoidance proposal and supply an instruction along the avoidance proposal to the aircraft of interest. The avoidance proposal selected by the air traffic controller may be input to the air traffic control assistance system of the present invention via the external system. Since one avoidance proposal corresponds to one aircraft, selection of an avoidance proposal corresponds to selection of an aircraft of interest.

The avoidance proposal includes, for example, information such as the ID of an avoidance proposal, the ID of an aircraft whose state is to be changed, the details of a state change (details of a change in speed or altitude), and start and end time of the change.

Figure 2:
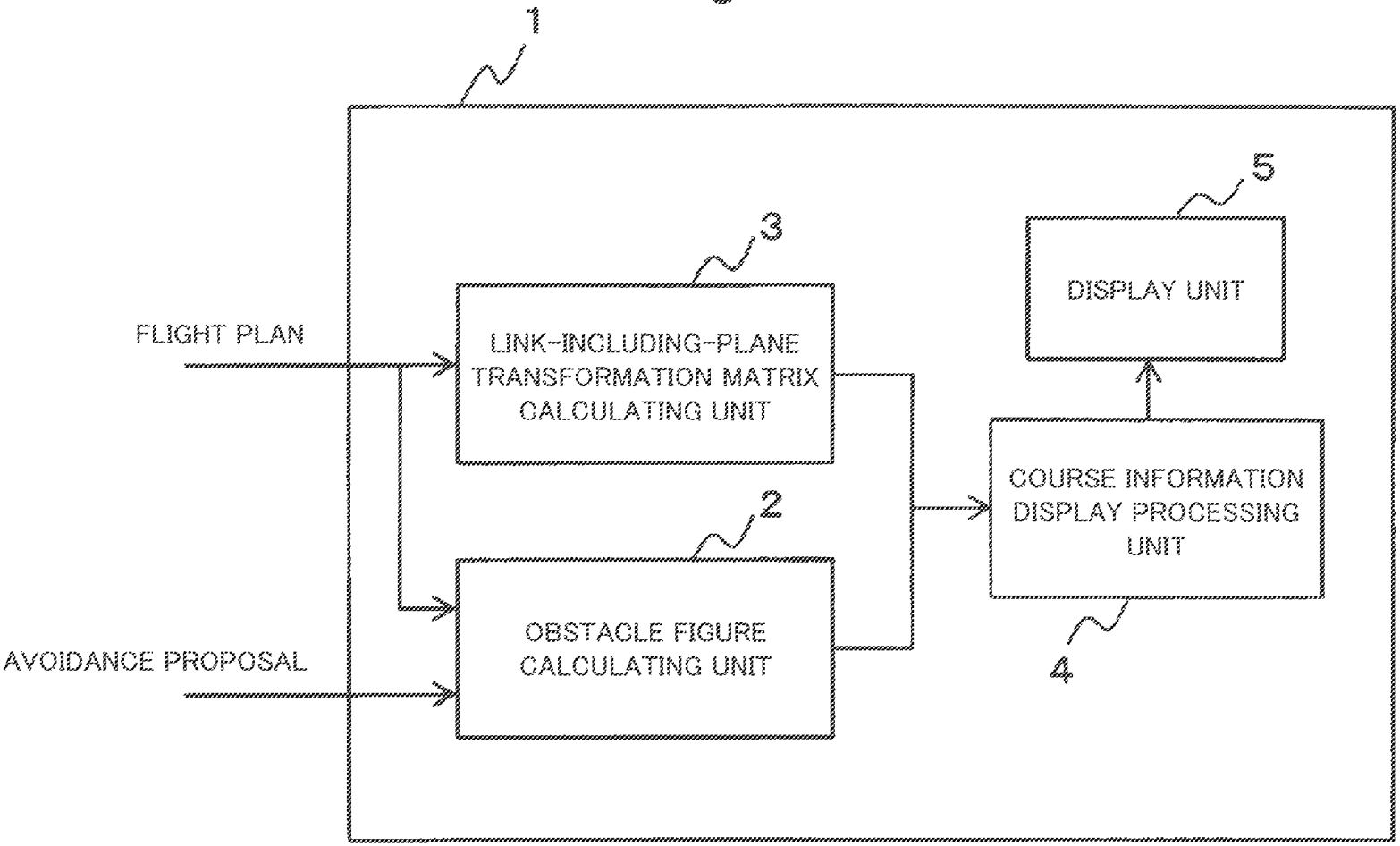
FIG. 2 is a block diagram illustrating a configuration example of an air traffic control assistance system of a first exemplary embodiment of the present invention.

FIG. 2 is a block diagram illustrating a configuration example of an air traffic control assistance system of a first exemplary embodiment of the present invention. An air traffic control assistance system 1 of the present invention includes an obstacle figure calculating unit 2, a link-including-plane transformation matrix calculating unit 3, a course information display processing unit 4, and a display unit 5.

The display unit 5 is a display device. The display unit 5 may be a display device commonly used by the above-described external system (not illustrated).

To the air traffic control assistance system 1 of the present invention, in addition to an avoidance proposal selected by an air traffic controller, a flight plan of each of aircraft is also input. Information of the position of the present aircraft of interest is also input together with the avoidance proposal to the air traffic control assistance system 1.

The obstacle figure calculating unit 2 receives input of the avoidance proposal selected by the air traffic controller and flight plans. According to the avoidance proposal, the obstacle figure calculating unit 2 calculates a link in the case of changing the state (speed or altitude) of the aircraft of interest indicated by the avoidance proposal. The obstacle figure calculating unit 2 calculates time when the aircraft of interest passes each of the FIXs on the basis of the speed of the aircraft of interest after the state change according to the avoidance proposal. It is sufficient for the obstacle figure calculating unit 2 to determine the start and end points of a link by adding the time to the x and y coordinates of the FIX. Since each of the start and end points of a link is expressed by the x and y coordinates in a map expressed two-dimensionally and the t coordinate expressing the passing time, the change in altitude does not exert an influence on the link. The obstacle figure calculating unit 2 calculates a figure expressing an obstacle (specifically, a figure expressing a range of an oceanic air traffic control separation of an aircraft in vicinity) by using each of the links of the aircraft of interest after the state change according to the avoidance proposal and links of aircrafts in vicinity (aircrafts other than the aircraft of interest). The figure is a figure in a three-dimensional space defined by the x and y axes in the map expressed two-dimensionally and the t axis expressing the passing time. Hereinbelow, the figure will be described.

Figure 3:
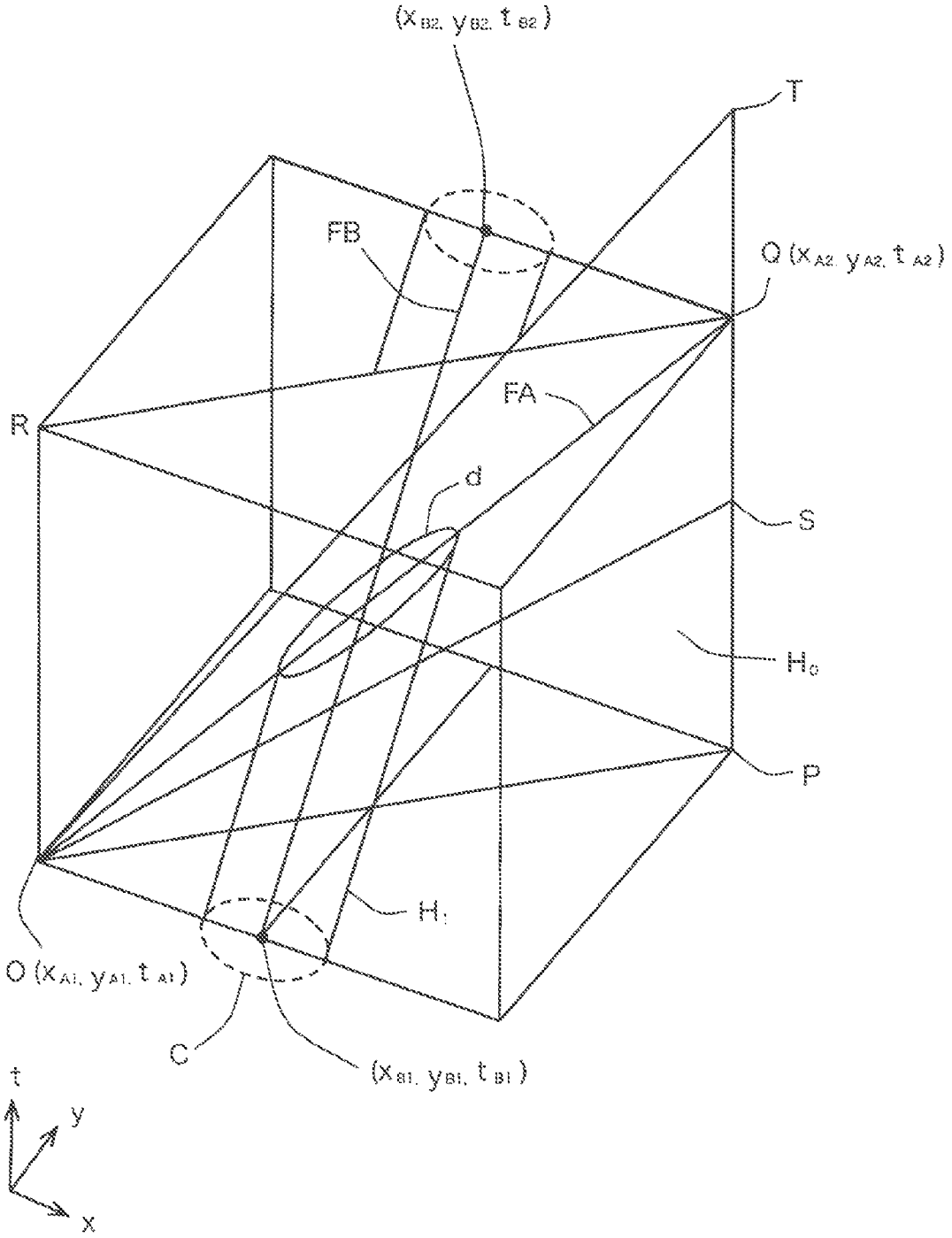
FIG. 3 is a schematic diagram illustrating a figure expressing a range of an oceanic air traffic control separation of an aircraft in vicinity.

FIG. 3 is a schematic diagram illustrating a figure expressing the range of an oceanic air traffic control separation of an aircraft in vicinity. One link is expressed by a form of [(x coordinate of start point, y coordinate of start point, t coordinate of start point), (x coordinate of end point, y coordinate of end point, and t coordinate of end point)].

The obstacle figure calculating unit 2 calculates each of links of an aircraft of interest after a state change according to an avoidance proposal. The obstacle figure calculating unit 2 specifies a combination of a link of an aircraft of interest and a link of an aircraft in vicinity whose time zones from the start point time to the end point time are at least partly overlapped. The obstacle figure calculating unit 2 sets all of aircrafts other than the aircraft of interest as aircrafts in vicinity and specifies a combination of a link of the aircraft of interest and a link of an aircraft in vicinity. FIG. 3 illustrates a combination of a set of links.

In an example illustrated in FIG. 3, a link FA is a link of an aircraft of interest. A link FB is a link of an aircraft in vicinity. It is assumed that FA=[($x_{A1}$, $y_{A1}$, $t_{A1}$), ($x_{A2}$, $y_{A2}$, $t_{A2}$)], and FB=[($x_{B1}$, $y_{B1}$, $t_{B1}$), ($x_{A2}$, $y_{B2}$, $t_{B2}$)]. In FIG. 3, to make description simpler, it is assumed that the start point times of the links FA and FB are the same time and the end point times of the links FA and FB are also the same time. That is, the case where $t_{A1}=t_{B1}$ and $t_{A2}=t_{B2}$ will be described as an example. The end point times of the links FA and FB may not be the same time. In the case where the start point times of the links FA and FB are not common, it is sufficient for the obstacle figure calculating unit 2 to calculate a cross point between a plane determined by the later start point time of the links FA and FB and the link of the earlier start point time and replace the three-dimensional coordinates of the start point of the link of the earlier start point time with the three-dimensional coordinates of the cross point. By such an arithmetic operation, the start point times of the two links become common.

In the example illustrated in FIG. 3, in the case where the speed of the aircraft of interest is increased, the end point time of the link FA is advanced. In the case where the speed of the aircraft of interest is decreased, the end point time of the link FA is delayed. For example, a point S illustrated in FIG. 3 expresses the end point of a link in the case of increasing the speed of the aircraft of interest to the legal upper limit speed, and a point T expresses the end point of a link in the case of decreasing the speed of the aircraft of interest to the legal lower limit speed. The obstacle figure calculating unit 2 may calculate the points S and T. In other words, the obstacle figure calculating unit 2 may obtain time when the aircraft of interest passes an FIX in the case where the aircraft of interest travels at the legal upper limit speed or the legal lower limit speed. By changing the speed of the aircraft of interest in such a manner, a plane including a start point O of the link FA and the points S and T is defined. Hereinbelow, the plane will be described as $H_0$. The plane $H_0$ is a plane including lines connecting the FIXs on the map expressed two-dimensionally and perpendicular to the xy plane.

A state of determining a circle using a point on the link FB as a center and whose radius is an oceanic air traffic control separation for each of points on the link FB of an aircraft in vicinity is assumed. It is assumed that the circle is a circle parallel to the plane including the x axis and the y axis illustrated in FIG. 3. Consequently, as illustrated in FIG. 3, an oblique column H1 whose bottom is a circle is determined. The oblique column H1 is a column body obtained by moving a circle, parallel to the xy plane and whose radius is the same as the oceanic air traffic control separation, along the link FB.

The intersection between the plane $H_0$ and the oblique column H1 is expressed by an ellipse "d" as illustrated in FIG. 3. The ellipse "d" exists on the plane $H_0$. When the ellipse "d" and the link FA intersect in the three-dimensional space illustrated in FIG. 3, it means that a conflict occurs. When the ellipse "d" and the link FA do not intersect, it means that no conflict occurs. The ellipse "d" is a figure expressing a figure expressing the range of the oceanic air traffic control separation of an aircraft in vicinity in the plane $H_0$ including a three-dimensional vector of a link of an aircraft of interest and perpendicular to the xy plane. The obstacle figure calculating unit 2 obtains the ellipse "d" on the basis of a combination of a link of an aircraft of interest and a link of an aircraft in vicinity whose time zones from the start point time to the end point time are at least partly overlapped.

A process of calculating the ellipse "d" by the obstacle figure calculating unit 2 will be specifically described. The obstacle figure calculating unit 2 specifies a circle "c" using the start point ($x_{B1}$, $y_{B1}$, $t_{B1}$) of the link FB as a center and whose radius is the oceanic air traffic control separation. The obstacle figure calculating unit 2 transforms the circle "c" to the ellipse "d" by calculation of Equation (1) expressed below.

[Math. 1]

$$\begin{pmatrix} 1-c_1(y_{A2}-y_{A1}) & 0+c_1(x_{A2}-x_{A1}) & 0 & -c_1D_2 \\ 0-c_2(y_{A2}-y_{A1}) & 1+c_2(x_{A2}-x_{A1}) & 0 & -c_2D_2 \\ 0-c_3(y_{A2}-y_{A1}) & 0+c_3(x_{A2}-x_{A1}) & 1 & -c_3D_2 \end{pmatrix} \begin{pmatrix} x \\ y \\ t \\ 1 \end{pmatrix} \quad \text{Equation (1)}$$

$c_1$, $c_2$, and $c_3$ are obtained by the following equations (2), (3), and (4), respectively.

$$c_1=(x_{B2}-x_{B1})/D_1 \quad \text{Equation (2)}$$

$$c_2=(y_{B2}-y_{B1})/D_1 \quad \text{Equation (3)}$$

$$c_3=(t_{B2}-t_{B1})/D_1 \quad \text{Equation (4)}$$

$D_1$ in the equations (2), (3), and (4) is obtained by the calculation of the following equation (5).

[Math. 2]

$$D_1 = \begin{vmatrix} x_{B2} - x_{B1} & y_{B2} - y_{B1} \\ x_{A2} - x_{A1} & y_{A2} - y_{A1} \end{vmatrix} \quad \text{Equation (5)}$$

$D_2$ in the equation (1) is obtained by the calculation of the following equation (6).

[Math. 3]

$$D_1 = \begin{vmatrix} x_{A1} & y_{A1} \\ x_{A2} & y_{A2} \end{vmatrix} \quad \text{Equation (6)}$$

Specifically, it is sufficient for the obstacle figure calculating unit 2 to sample a plurality of points on the circumference of the circle "c", substitute the x coordinate, the y coordinate, and the t coordinate for x, y, and t in the equation (1), and perform the calculation of the equation (1). Three-dimensional coordinates obtained by the calculation result are points on the circumference of the ellipse "d" in the three-dimensional space illustrated in FIG. 3. That is, by performing the calculation of the equation (1) on a plurality of points sampled from the circle "c", the obstacle figure calculating unit 2 obtains the sampling points on the circumference of the ellipse "d." Hereinbelow, a sampling point on the circumference of the ellipse "d" will be simply described as a sampling point on the ellipse "d."

Between the aircraft of interest and one aircraft in vicinity, there are a plurality of combinations of links whose time zones from the start point time to the end point time are at least partly overlapped. Further, a plurality of aircrafts in vicinity exist. Consequently, when the obstacle figure calculating unit 2 specifies all of the combinations of links whose time zones from the start point time to the end point time are at least partly overlapped for each of sets of the aircraft of interest and the aircraft in vicinity and performs calculation of obtaining sampling points on the ellipse "d" for each of the sets of the links, the calculation amount of the obstacle figure calculating unit 2 becomes large. Further, it does not experimentally occur that two aircrafts come close each other once and, after that, come close each other again.

Preferably, the obstacle figure calculating unit 2 specifies all of combinations of links whose time zones from the start point time to the end point time are at least partly overlapped for each of the sets of the aircraft of interest and the aircraft in vicinity and then, for each of the combinations of the links, performs a process of determining whether the ellipse "d" (more specifically, the sampling points on the ellipse "d") is calculated or not. Preferably, the obstacle figure calculating unit 2 calculates the ellipse "d" for only a combination of links determined to calculate the ellipse "d." An example of a process of determining whether the ellipse "d" is calculated or not will be described hereinafter.

A rectangle OPQR (refer to FIG. 3) using the link FA as a diagonal will be examined. O is the start point of the link FA, and Q is the end point of the link FA. The coordinates of P are ($x_{A2}$, $y_{A2}$, $t_{A1}$) and the coordinates of R are ($x_{A1}$, $y_{A1}$, $t_{A2}$). The rectangle OPQR exists on the plane $H_0$. The obstacle figure calculating unit 2 substitutes the coordinates of the points Q and R for x, y, t in the following equation (7) and performs the calculation of the equation (7), thereby projecting the points Q and R onto a plane $t=t_{A1}$.

[Math. 4]

$$\begin{pmatrix} 1 & 0 & -c_4 & c_4 t_{A1} \\ 0 & 1 & -c_5 & c_5 t_{A1} \\ 0 & 0 & 0 & t_{A1} \end{pmatrix} \begin{pmatrix} x \\ y \\ t \\ 1 \end{pmatrix} \quad \text{Equation (7)}$$

c4 and c5 are values obtained by calculation of the following equations (8) and (9), respectively.

$$c_4=(x_{B2}-x_{B1})/(t_{B2}-t_{B1}) \quad \text{Equation (8)}$$

$$c_5=(y_{B2}-y_{B1})/(t_{B2}-t_{B1}) \quad \text{Equation (9)}$$

Points obtained by projecting the points Q and R onto the plane of $t=t_{A1}$ by the equation (7) are set as Q' and R' (not illustrated). As a result, a quadrilateral (not illustrated) using the points O, P, Q', and R' as apexes is determined. The obstacle figure calculating unit 2 calculates the distance between the quadrilateral OPQ'R' and the circle "c." When the distance is less than a threshold value, the obstacle figure calculating unit 2 may determine that the ellipse "d" will be calculated. When the distance is equal to or larger than the threshold value, the obstacle figure calculating unit 2 may determine that the ellipse "d" will not be calculated. When the rectangle OPQ'R' and the circle "c" are overlapped even partly, the obstacle figure calculating unit 2 may regard the distance between them as zero.

The obstacle figure calculating unit 2 calculates the sampling points on the ellipse "d" for a combination of a link of the aircraft of interest and a link of the aircraft in vicinity, associates identification information of the combination of the links to the set of the sampling points on one ellipse "d" calculated from a pair of links, and inputs the information to the course information display processing unit 4.

Next, the link-including-plane transformation matrix calculating unit 3 (hereinbelow, described as the transformation matrix calculating unit 3) will be described. In the output screen (FIG. 1) of the present invention, the horizontal axis indicates FIXs. However, FIXs in reality are not generally arranged on one straight line. The transformation matrix calculating unit 3 calculates, for each of two-dimensional vectors, a transformation matrix expressing transformation from a plane including a two-dimensional vector and perpendicular to the xy plane to a plane defined by the x axis and the t axis (time axis) in the case of transforming each two-dimensional vector in the xy plane extending from one FIX to the next FIX along a route of the aircraft of interest so as to be arranged along the x axis in accordance with the order of the FIXs.

The transformation matrix calculating unit 3 may calculate transformation matrices, for example, in order from a two-dimensional vector whose start point is an FIX through which the aircraft of interest passes earliest from the present time point. The FIX passed earliest can be specified on the basis of the present position of the aircraft of interest. In the exemplary embodiment, it is assumed that the transformation matrix calculating unit 3 does not calculate the transformation matrix on a two-dimensional vector whose start point is an FIX through which the aircraft of interest already has passed. The two-dimensional vector to be processed by the transformation matrix calculating unit 3 is not limited to the example. For example, the transformation matrix calculating unit 3 may conveniently determine the present position of the aircraft of interest as FIX1, specify each two-dimensional vector vAi, and calculate a transformation matrix on the vAi.

Figure 4:
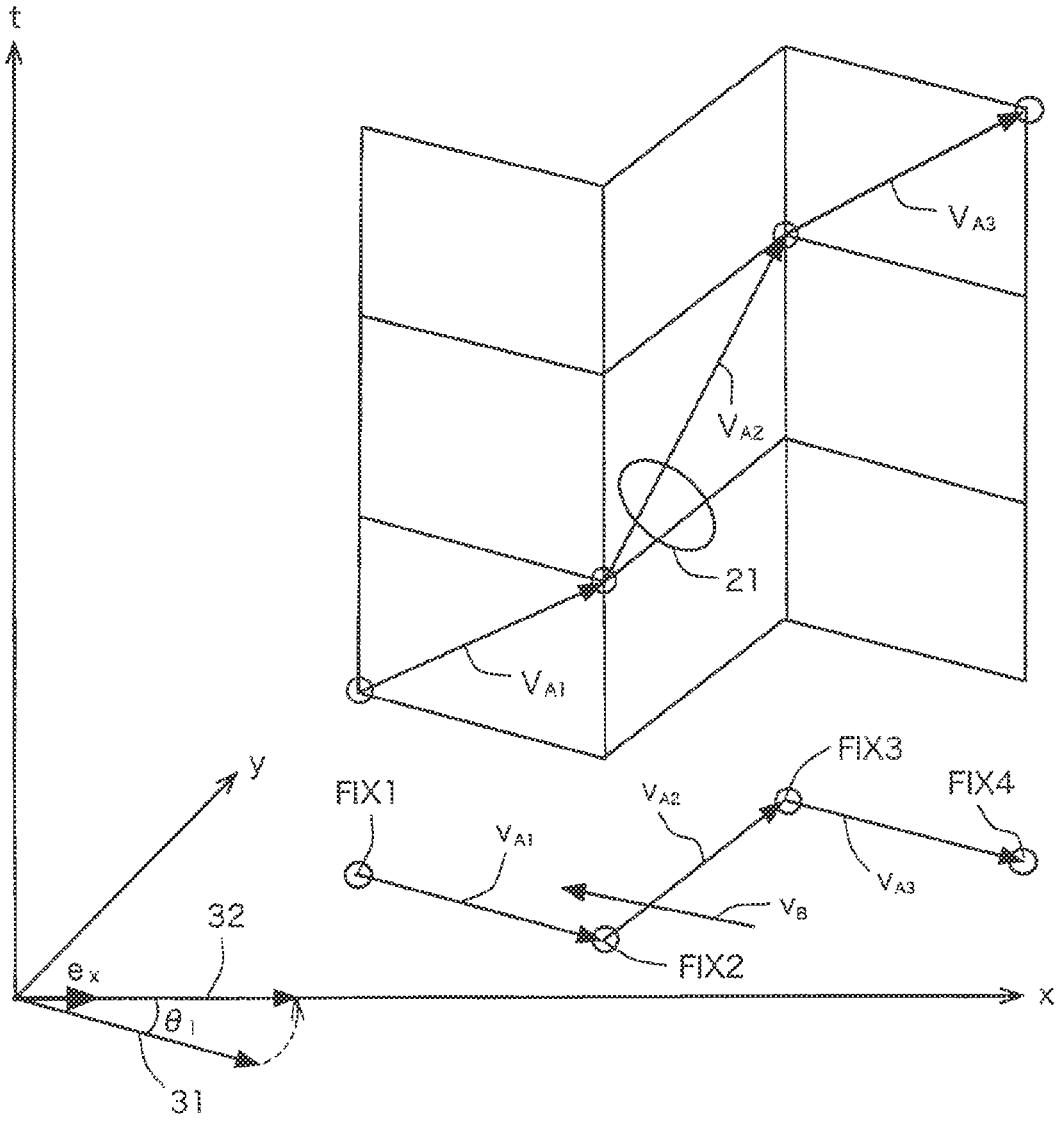
FIG. 4 is an explanatory diagram illustrating transformation matrix calculating process.
Figure 5:
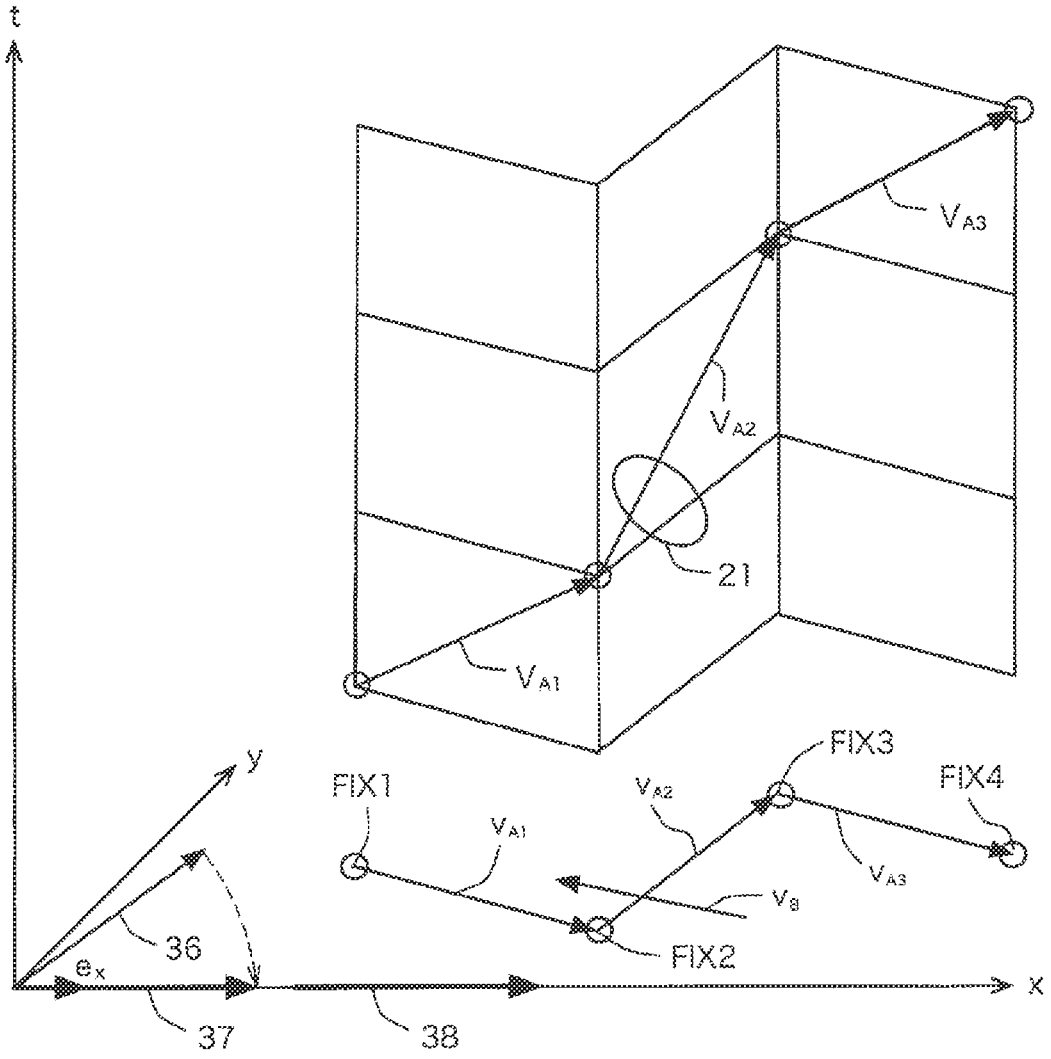
FIG. 5 is an explanatory diagram illustrating transformation matrix calculating process.

FIGS. 4 and 5 are explanatory diagrams illustrating a transformation matrix calculating process by the transformation matrix calculating unit 3. It is assumed that FIXs through which the aircraft of interest passes are determined in order of FIX1, FIX2, FIX3, and FIX4 in a flight plan along the route of the aircraft of interest. FIX1 is an FIX through which the aircraft of interest passes earliest from the present time point. FIXs through which the aircraft of interest already has passed are ignored. The coordinates of the i-th FIX in FIX1 and subsequent FIXs are expressed as $(x_{Ai}, y_{Ai})$. A two-dimensional vector in the xy plane extending from the i-th FIX toward the next FIX is expressed as $v_{Ai}$. $v_{Ai}$ can be expressed by the following equation (10).

$$v_{Ai}=(x_{Ai+1}-x_{Ai}, y_{Ai+1}-y_{Ai}) \quad \text{Equation (10)}$$

In the case where the number of FIXs is set as "n", i is an integer of 1 to n−1.

As illustrated in FIGS. 4 and 5, the FIXs do not exist on one straight line. On the other hand, in the output screen (refer to FIG. 1), the FIXs are expressed on one axis. The FIXs on the x axis illustrated in FIG. 1 are expressed as FIXs in the case of arranging two-dimensional vectors each extending from one FIX to the next FIX on the x axis while maintaining the magnitude of the two-dimensional vectors.

In a three-dimensional space obtained by adding the t axis to the x axis and the y axis (refer to FIGS. 4 and 5), a plane including a two-dimensional vector extending from one FIX to the next FIX and perpendicular to the xy plane corresponds to the plane $H_0$ illustrated in FIG. 3. Each of the links of the aircraft of interest exists in the plane $H_0$. $V_{Ai}$ illustrated in FIGS. 4 and 5 indicates a link corresponding to $v_{Ai}$.

It can be also said that, in the case of paying attention to the two-dimensional vector $v_{Ai}$, the transformation matrix calculating unit 3 calculates a transformation matrix of transforming a point in a plane including $v_{Ai}$ and perpendicular to the xy plane to a point in the xt plane. The xt plane is a plane defined by the x axis and the t axis. Hereinbelow, calculation of the transformation matrix on $v_{Ai}$ will be described.

First, the transformation matrix calculating unit 3 determines a transformation matrix (indicated as $m_i^{(1)}$) which parallel-translates $v_{Ai}$ to the origin. $m_i^{(1)}$ is expressed by the following equation (11).

[Math. 5]

$$m_i^{(1)} = \begin{pmatrix} 1 & 0 & 0 & -x_{Ai} \\ 0 & 1 & 0 & -y_{Ai} \\ 0 & 0 & 1 & 0 \\ 0 & 0 & 0 & 1 \end{pmatrix} \quad \text{Equation (11)}$$

Calculation of the transformation will be described with paying attention to the end point of $v_{Ai}$. The coordinates of the end point of $v_{Ai}$ are expressed as $(x_{Ai+1}, y_{Ai+1})$. The transformation by the equation (11) is performed by adding 1 as third and fourth elements to the coordinates to derive $(x_{Ai+1}, y_{Ai+1}, 1, 1)$, and multiplying the transposed matrix of $(x_{Ai+1}, y_{Ai+1}, 1, 1)$ from the right side of $m_i^{(1)}$.

Next, the transformation matrix calculating unit 3 determines a transformation matrix (indicated as $m_i^{(2)}$) which turns a vector obtained by transforming $v_{Ai}$ by the transformation matrix $m_i^{(1)}$ so as to be the same direction as the x axis. $m_i^{(2)}$ is expressed by the following equation (12).

[Math. 6]

$$m_i^{(2)} = \begin{pmatrix} \cos\theta_i & -\sin\theta_i & 0 & 0 \\ \sin\theta_i & \cos\theta_i & 0 & 0 \\ 0 & 0 & 1 & 0 \\ 0 & 0 & 0 & 1 \end{pmatrix} \quad \text{Equation (12)}$$

$\theta_i$ denotes an angle formed by the vector obtained by transforming $v_{Ai}$ by the transformation matrix $m_i^{(1)}$ and the x axis and is an angle in the range of $-\pi$ to $\pi$. When an identity matrix along the x axis is expressed as $e_x$, $\theta_i$ is calculated by the following equation (13).

[Math. 7]

$$\theta_i = \begin{cases} 0 & \text{(in the case where } v_{Ai} \text{ after parallel translation is on the } x \text{ axis)} \\ -\cos^{-1}\frac{e_x \cdot v_{Ai}}{|v_{Ai}|} & \text{(in the case where } v_{Ai} \text{ after parallel translation is on the left side of ex)} \\ \cos^{-1}\frac{e_x \cdot v_{Ai}}{|v_{Ai}|} & \text{(in the case where } v_{Ai} \text{ after parallel translation is on the right side of ex)} \end{cases} \quad \text{Equation (13)}$$

Next, the transformation matrix calculating unit 3 calculates a transformation matrix (indicated as $m_i^{(3)}$) which parallel translates a vector obtained by transforming $v_{Ai}$ by the transformation matrices $m_i^{(1)}$ and $m_i^{(2)}$ along the x axis. $m_i^{(3)}$ is expressed by the following equation (14).

[Math. 8]

$$m_i^{(3)} = \begin{pmatrix} 1 & 0 & 0 & \alpha \\ 0 & 1 & 0 & 0 \\ 0 & 0 & 1 & 0 \end{pmatrix} \quad \text{Equation (14)}$$

$\alpha$ in the equation (14) denotes a parallel translation amount at the time of performing translation parallel to the x-axis direction. Specifically, the value of $\alpha$ used at the time of calculating a transformation matrix by paying attention to $v_{Ai}$ is a sum of magnitudes of vectors from $v_{A1}$ to $v_{Ai-1}$. The value of $\alpha$ used at the time of calculating a transformation matrix by paying attention to the first two-dimensional vector $v_{A1}$ is zero.

The transformation matrix calculating unit 3 obtains a transformation matrix (indicated as $M_i$) expressing transformation from a plane including the two-dimensional vector $v_A$, and perpendicular to the xy plane to the xt plane by calculation of the following equation (15).

$$M_i=m_i^{(3)}m_i^{(2)}m_i^{(1)} \quad \text{Equation (15)}$$

A point in the plane including the two-dimensional vector $v_{Ai}$ and perpendicular to the xy plane is transformed to the xt plane by the transformation matrix $M_i$. A point in the plane including $v_{Ai}$ and perpendicular to the xy plane is expressed by an x coordinate, a y coordinate, and a t coordinate. In the case of transforming the point by $M_i$, it is sufficient to perform an operation of adding "1" as a fourth element to the three elements to obtain (x, y, t, 1) and multiplying the transposed matrix of (x, y, t, 1) from the right side of $M_i$. The first element of the vector obtained as a result corresponds to the x coordinate, and the third element corresponds to the t coordinate. The t coordinate is not changed by the transformation matrix $M_i$.

In FIG. 4, attention is paid to the first two-dimensional vector $v_{A1}$, and vectors obtained by transforming $v_{A1}$ in order by and $m_1^{(1)}$, $m_1^{(2)}$, $m_1^{(3)}$ are illustrated. A vector obtained by parallel translating $v_{A1}$ to the origin by using the transformation matrix $m_1^{(1)}$ is illustrated as a vector 31. A vector obtained by turning the vector 31 in the same direction as the x axis by using the transformation matrix m2(1) is illustrated as a vector 32. Paying attention to $v_{A1}$, since a used in the case of determining $m_1^{(3)}$ (refer to the equation (14)) is zero, the vector 32 is not shifted by $m_1^{(3)}$. Therefore, $v_{A1}$ is transformed to the vector 32 by $M_1$. A point in a plane including $v_{A1}$ and perpendicular to the xy plane is also transformed to the xt plane.

In FIG. 5, attention is paid to the second two-dimensional vector $v_{A2}$, and vectors obtained by transforming $v_{A2}$ in order by $m_2^{(1)}$, $m_2^{(2)}$, and $m_2^{(3)}$ are illustrated. A vector obtained by parallel translating $v_{A2}$ to the origin by using the transformation matrix $m_2^{(1)}$ is illustrated as a vector 36. A vector obtained by transforming the vector 36 in the same direction as the x axis by using the transformation matrix $m_2^{(2)}$ is illustrated as a vector 37. $\alpha$ used in the case of determining $m_1^{(3)}$ (refer to the equation (14)) is a sum of magnitudes of vectors from $v_{A1}$ to $v_{Ai-1}$. Therefore, in the exemplary embodiment, $\alpha$ denotes the magnitude of the two-dimensional vector $v_{A1}$. A vector obtained by parallel translating the vector 37 in the x-axis direction only by the magnitude of the vector $v_{A1}$ by using $m_2^{(3)}$ is illustrated as a vector 38. Therefore, $v_{A2}$ is transformed to the vector 38 by $M_2$. A point in the plane including $v_{A2}$ and perpendicular to the xy plane is also transformed to the xt plane.

The course information display processing unit 4 specifies the position of each of FIXs in the case of arranging the FIXs on the x axis while maintaining the magnitude of the two-dimensional vector from one FIX to the next FIX. For example, the course information display processing unit 4 may specify the position of an FIX on the x axis by applying, to the start point of a two-dimensional vector in the xy plane illustrated in FIGS. 4 and 5, the transformation matrix $M_i$ corresponding to the two-dimensional vector. Although the case of applying the transformation matrix $M_i$ to the start point of a two-dimensional vector is exemplified here, the course information display processing unit 4 may apply the transformation matrix $M_i$ to the end point of a two-dimensional vector. The course information display processing unit 4 may also specify the position of an FIX on the x axis by accumulating values of magnitudes of vectors without using the transformation matrix $M_i$.

Time at which the aircraft of interest after the state change based on the avoidance proposal passes through each FIX is determined by the obstacle figure calculating unit 2. The course information display processing unit 4 determines a reference line in the xt plane by connecting points each determined by a combination of the time and the position on the x axis (x coordinate) specified as the position of the FIX and displays the reference line together with the x axis and the t axis in the display unit 5. As a result, the reference line 11 illustrated in FIG. 1 is displayed together with the x axis (the horizontal axis illustrated in FIG. 1) and the t axis (time axis, which is the vertical axis illustrated in FIG. 1). The course information display processing unit 4 displays, in the display unit 5, the t axis using, for example, start time of the state change of the aircraft instructed by the avoidance proposal selected by the air traffic controller as an intersection point with the x axis.

The course information display processing unit 4 transforms sampling points on the ellipse "d" (refer to FIG. 3) calculated by the obstacle figure calculating unit 2 for a combination of a link of the aircraft of interest and a link of the aircraft in vicinity to the xt plane by the transformation matrix $M_i$ calculated by the transformation matrix calculating unit 3 and makes an ellipse in the xt plane specified by the transformed points displayed together with the x axis and the t axis. Hereinbelow, an ellipse display process will be specifically described.

With a set of sampling points on the ellipse "d" calculated from a pair of links, identification information of the combination of the links is associated. The course information display processing unit 4 specifies the link of the aircraft of interest by the identification information and specifies the transformation matrix $M_i$ corresponding to the link of the aircraft of interest. The link of the aircraft of interest corresponds to the two-dimensional vector $v_{ai}$ (refer to FIG. 4) expressed in the xy plane. Therefore, the course information display processing unit 4 can specify the transformation matrix $M_i$ from the link of the aircraft of interest. By applying the transformation matrix $M_i$ to each of the sampling points on the ellipse "d", the course information display processing unit 4 transforms the sampling point to the xt plane. Specifically, the course information display processing unit 4 adds, as a fourth element, 1 to the x coordinate, y coordinate, and t coordinate of a sampling point to obtain (x, y, t, 1). Then, it is sufficient for the course information display processing unit 4 to multiply the transposed matrix of (x, y, t, 1) from the right side of $M_i$. The first element (x coordinate) and the third element (t coordinate) of a vector obtained by the multiplication of the matrix express the point transformed onto the xt plane. For example, it is assumed that, as illustrated in FIGS. 4 and 5, a sampling point on an ellipse 21 is obtained by a combination of the link $V_{A2}$ of the aircraft of interest between FIX2 and FIX3 and a link (not illustrated) of an aircraft in vicinity corresponding to the two-dimensional vector $v_B$. The course information display processing unit 4 transforms the sampling point to a point on the xt plane by applying the transformation matrix $M_2$ to the sampling point on the ellipse 21. The course information display processing unit 4 displays, in the display unit 5, an ellipse in the xt plane determined by the transformed sampling points together with the reference line 11, the x axis, and the t axis.

At this time, the course information display processing unit 4 performs a process of transforming each set of sampling points on the ellipse "d" calculated from a pair of links to the xt plane. The course information display processing unit 4 displays, in the display unit 5, each of ellipses determined by the sampling points transformed to the xt plane. As a result, the ellipse 15 illustrated in FIG. 1 is displayed. It is sufficient for the course information display processing unit 4 to specify an ellipse in the xt plane by, for example, interpolating the transformed sampling points.

The course information display processing unit 4 may display, in the display unit 5, a line connecting points each determined by a combination of passing time of each of FIXs in the case where the aircraft of interest travels at the legal upper limit speed and the position on the x axis (x coordinate) specified as the position of the FIX. Similarly, the course information display processing unit 4 may make the display unit 5 display the line connecting points each determined by a combination of passing time of each of FIXs in the case where the aircraft of interest travels at the legal lower limit speed and the position on the x axis specified as the position of the FIX together with the x axis and the t axis. As a result, the lines 12 and 13 illustrated in FIG. 1 are also displayed. The course information display processing unit 4 may not make the display unit 5 display the lines 12 and 13 (refer to FIG. 1).

The course information display processing unit 4 may display the output screen by limiting the range of the t axis to time of predetermined length. In the example illustrated in FIG. 1, the range of the t axis is limited to length of one hour. In the example illustrated in FIG. 1, any ellipse corresponding to the time zone after 13:00 is not displayed. The size of the range displayed as the output screen may be predetermined in such a manner. The course information display processing unit 4 may display the ellipse, the reference line, and the like within the range.

The obstacle figure calculating unit 2, the transformation matrix calculating unit 3, and the course information display processing unit 4 are realized by, for example, a CPU (Central Processing Unit) which operates according to a computer. For example, the CPU may read an air traffic control assistance program and operate as the obstacle figure calculating unit 2, the transformation matrix calculating unit 3, and the course information display processing unit 4 in accordance with the program. The air traffic control assistance program may be stored in a computer readable recording medium. Alternatively, the obstacle figure calculating unit 2, the transformation matrix calculating unit 3, and the course information display processing unit 4 may be realized by separate hardware.

Figure 6:
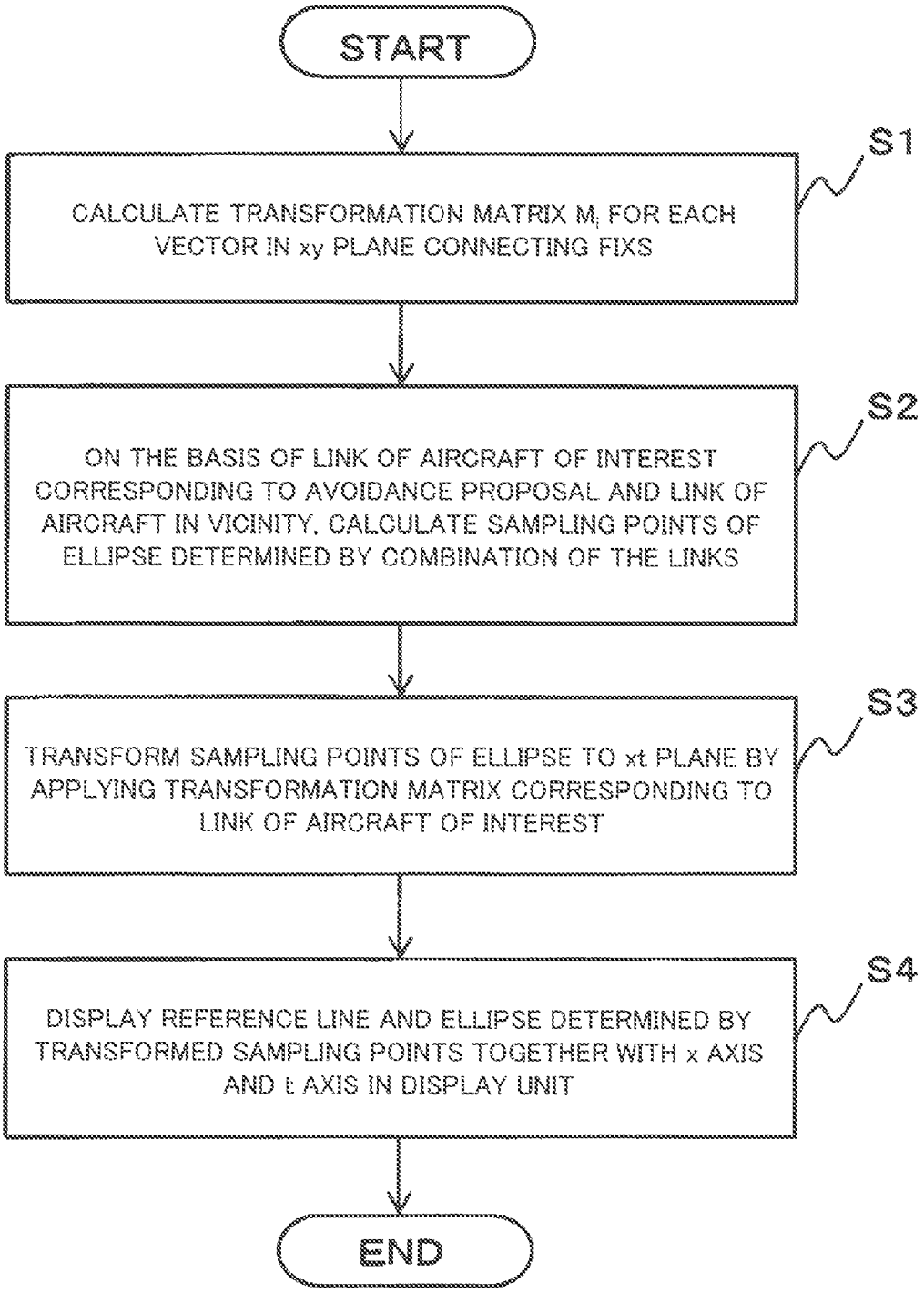
FIG. 6 is a flowchart illustrating an example of process lapse of the first exemplary embodiment of the present invention.

FIG. 6 is a flowchart illustrating an example of lapse of processes in the first exemplary embodiment of the present invention. It is assumed that a flight plan is preliminarily input to the air traffic control assistance system 1. It is also assumed that an external system (not illustrated) detects a conflict and generates a plurality of avoidance proposals to avoid the conflict and an air traffic controller selects one avoidance proposal for the purpose of checking the output screen exemplified in FIG. 1. It is assumed that, for example, the avoidance proposal selected by the air traffic controller and information of the present position of an aircraft of interest whose state is to be changed by the avoidance proposal are input from the external system to the air traffic control assistance system 1.

When the avoidance proposal selected by the air traffic controller and the like are input, the transformation matrix calculating unit 3 calculates the transformation matrix Mi for each of vectors in the xy plane each connecting FIXs through which the aircraft of interest indicated by the avoidance proposal passes (step S1). Since the process of calculating the transformation matrix Mi for each of vectors in the xy plane connecting the FIXs has been already described, the description will be omitted here. The transformation matrix calculating unit 3 inputs each of the calculated transformation matrices Mi to the course information display processing unit 4.

When the avoidance proposal selected by the air traffic controller is input, the obstacle figure calculating unit 2 calculates each of links in the case of changing the state (speed or altitude) of the aircraft of interest in accordance with the avoidance proposal. For example, as long as the transformation matrix calculating unit 3 calculates transformation matrices in order from a two-dimensional vector whose start point is an FIX through which the aircraft of interest passes earliest from the present time point, it is sufficient for the obstacle figure calculating unit 2 to generate each of a link using, as the start point, the FIX through which the aircraft of interest passes earliest from the present time point and subsequent links. As described above, it is sufficient for the obstacle figure calculating unit 2 to generate a link corresponding to the two-dimensional vector $v_{Ai}$ as a target of calculating a transformation matrix by the transformation matrix calculating unit 3 as a link of the aircraft of interest in the case where the state is changed. The obstacle figure calculating unit 2 refers to the links of the aircraft of interest and links of the aircraft in vicinity and specifies combinations of links of the aircraft of interest and links of an aircraft in vicinity whose time zones from the start point time to the end point time are at least partly overlapped. For each of the combinations, the obstacle figure calculating unit 2 calculates sampling points on the ellipse "d" (refer to FIG. 3) determined by the combination of the link of the aircraft of interest and the link of the aircraft in vicinity (step S2). Since the process of calculating the sampling points on the ellipse "d" when the combination of the link of the aircraft of interest and the link of the aircraft in vicinity is given has been already described, the description will be omitted here. The obstacle figure calculating unit 2 associates the identification information of the combination of the links to the set of the sampling points on one ellipse "d" calculated from the pair of links, and inputs the information to the course information display processing unit 4.

The course information display processing unit 4 transforms the set of the sampling points on the ellipse "d" calculated for the combination of the link of the aircraft of interest and the link of the aircraft in vicinity onto the xt plane by the transformation matrix $M_i$ corresponding to the link of the aircraft of interest (step S3). The course information display processing unit 4 performs the transformation of the sampling points on the ellipse for each of the sets of the sampling points on the ellipse "d" calculated from the pair of links.

The course information display processing unit 4 specifies the position of each of the FIXs in the case of arranging the FIXs on the x axis while maintaining the magnitude of a two-dimensional vector from one FIX to the next FIX. The course information display processing unit 4 specifies a point determined by the combination of time when the aircraft of interest after the state change based on the avoidance proposal passes through each of the FIXs and the position on the x axis specified as the position of the FIX. The course information display processing unit 4 displays, in the display unit 5, a line connecting the points (a reference line) together with the x axis and the t axis. At this time, on the basis of the sampling points on the ellipse on the xt plane obtained in step S3, the course information display processing unit 4 also displays an ellipse specified by the sampling points in the display unit 5 (step S4).

In step S4, the course information display processing unit 4 may also display the line 12 connecting points expressing passing time of the FIXs in the case where the aircraft of interest travels at the legal upper limit speed and the line 13 connecting points expressing passing time of the FIXs in the case where the aircraft of interest travels at the legal lower limit speed. In this case, it is sufficient that the obstacle figure calculating unit 2 calculates the passing time of each FIX in the case where the aircraft of interest travels at the legal upper limit speed or legal lower limit speed.

The course information display processing unit 4 displays, in the display unit 5, for example, the t axis using start time of the state change instructed in the avoidance proposal as the intersection point with the x axis. The size of the range to be displayed as the output screen may be preliminarily determined. For example, using the intersection point between the x axis and the t axis as a reference, the range of the x axis and the range of the t axis to be displayed may be preliminarily determined. The course information display processing unit 4 may display an ellipse, a reference line, and the like within the range.

As a result of step S4, the display screen exemplified in FIG. 1 is displayed in the display unit 5, and the air traffic controller checks the screen displayed in step S4. As described above, in the display screen exemplified in FIG. 1, the ellipse 15 expresses a proximity state between the aircraft of interest and the aircraft in vicinity. One ellipse corresponds to one aircraft in vicinity. It also illustrates that the closer the ellipse 15 to the reference line is, the more the aircraft in vicinity comes close to the aircraft of interest. Therefore, referring to the screen displayed in step S4, the air traffic controller can recognize probability of occurrence of a conflict after air traffic control is performed according to the selected avoidance proposal on the basis of the number of ellipses 15 and the distance between the ellipse 15 and the reference line 11. For example, it is understood that when an ellipse intersecting the reference line 11 is displayed, if air traffic control is performed according to the avoidance proposal, a conflict will be detected again and an avoidance proposal has to be selected again in the future. In the case where the ellipse 15 which does not cross the reference line 11 but is close to the reference line 11 is displayed, it is understood that a conflict may easily occur again in the future. Therefore, from the viewpoint that the smaller the number of ellipses 15 is, the more it is preferable and the more the ellipse 15 is apart from the reference line 11, the more it is preferable, an air traffic controller can determine reliability at present and in the future of the selected avoidance proposal.

More preferably, each of the ellipses 15 does not belong to the range sandwiched by the lines 12 and 13 (refer to FIG. 1).

In the display screen in step S4, as exemplified in FIG. 1, the vertical axis is set as the time axis. Therefore, the display screen in step S4 expresses not only the state in a certain point in the future but also the proximity state between the aircraft of interest and the aircraft in vicinity in a wide time zone. Consequently, an air traffic controller does not have to designate each time in the future but can understand, at a glance, the proximity state between the aircraft of interest and the aircraft in vicinity in a time zone in the future.

In the case where an unpreferable state such that the ellipse 15 and the reference line 11 cross each other is recognized, the air traffic controller selects another avoidance proposal. The air traffic control assistance system 1 executes steps S1 to S4 on the selected avoidance proposal. It is sufficient for the air traffic controller to employ an avoidance proposal which is reliable at present and in the future and instruct the aircraft of interest in accordance with the avoidance proposal.

As described above, according to the exemplary embodiment, reliability of an avoidance proposal at present and in the future can be displayed in a mode that an air traffic controller can easily understand.

Second Exemplary Embodiment

An air traffic control assistance system of a second exemplary embodiment of the present invention can be expressed by a configuration similar to that of FIG. 2. Hereinbelow, referring to FIG. 2, the second exemplary embodiment will be described. The operation of a transformation matrix calculating unit 3 is similar to that of the first exemplary embodiment, and its description will be omitted.

An obstacle figure calculating unit 2 performs the following operation in addition to the operation of the first exemplary embodiment. In the second exemplary embodiment, to the obstacle figure calculating unit 2, FIX passing time change information of an aircraft in vicinity is also input. The FIX passing time change information of an aircraft in vicinity is information expressing a change in FIX passing time of an aircraft in vicinity indicated in a flight plan. The FIX passing time change information of an aircraft in vicinity is generated by an air traffic controller and input to the obstacle figure calculating unit 2. A mode of inputting the FIX passing time change information of an aircraft in vicinity is not particularly limited. For example, an air traffic controller may perform an operation of advancing or retarding time when an aircraft in vicinity passes through a certain FIX by using an interface of an external system (not illustrated). According to the operation, the external system may input the FIX passing time change information of the aircraft in vicinity to the obstacle figure calculating unit 2.

An air traffic controller does not change a passing route of an aircraft in vicinity.

Using a link of an aircraft in vicinity as in a flight plan, the obstacle figure calculating unit 2 calculates a set of sampling points on an ellipse "d" in a manner similar to the first exemplary embodiment. In the case where the FIX passing time change information of the aircraft in vicinity is input, the obstacle figure calculating unit 2 changes the link of the aircraft in vicinity in accordance with the FIX passing time change information. The obstacle figure calculating unit 2 calculates a set of sampling points on an ellipse "d" by a combination of a link of the aircraft in vicinity after the change and a link of an aircraft of interest (link of the aircraft of interest in the case of changing the state according to the avoidance proposal).

Hereinbelow, using FIG. 3 as an example, the operation of the obstacle figure calculating unit 2 will be described. In terms of a link FB of an aircraft in vicinity illustrated in FIG. 3, it is assumed that FIX passing time change information indicating the content that the end point time of the link FB will be delayed by p minutes is input. It is assumed that no change is instructed as to the start point time of the link FB.

The obstacle figure calculating unit 2 calculates sampling points on the ellipse "d" on the basis of the combination of the link FA and the link FB before the change. The operation is similar to that of the first exemplary embodiment. Further, the obstacle figure calculating unit 2 changes the link FB to $[(x_{B1}, y_{B1}, t_{B1}), (x_{A2}, y_{B2}, t_{B2}+p)]$ according to the FIX passing time change information and, on the basis of the link after the change and the link FA of the aircraft of interest, calculates the sampling points on an ellipse in the three-dimensional space. A method of calculating an ellipse in the three-dimensional space is similar to that of the first exemplary embodiment.

In the exemplary embodiment, the end point time of the link FB is delayed by p minutes. The x coordinate and the y coordinate of the end point of the link FB are not changed. Consequently, an oblique column corresponding to the link of the aircraft in vicinity after the change is taller than the oblique column illustrated in FIG. 3. In addition, the angle formed by the oblique column and the xy plane becomes larger. Therefore, the size and shape of an ellipse determined by intersection of the oblique column and the plane $H_0$ (refer to FIG. 3) also change. In the example, the inclination of the ellipse with respect to the xy plane increases and the length of the ellipse in the major axis direction increases.

Although the case that the end point time of the link FB is delayed by p minutes has been exemplified, the link FB may be changed so as to advance the end point time of the link FB by p minutes. The start point time of the link FB may be advanced or delayed. Depending on a way of change in the link FB of an aircraft in vicinity, a way of change in an ellipse determined by intersection of the oblique column and the plane $H_0$ also changes. In any case, the obstacle figure calculating unit 2 specifies a combination of a link of an aircraft of interest and a link of an aircraft in vicinity after the change whose time zones from start point time to end point time are overlapped at least partly, performs calculation similar to that in the first embodiment on the combination, and also calculates a set of sampling points on an ellipse in the case of changing the link of the aircraft in vicinity.

The obstacle figure calculating unit 2 inputs not only the set of the sampling points on the ellipse calculated on the basis of the combination of the link FA and the link FB before the change but also the set of sampling points on the ellipse calculated on the basis of the combination of the link FA and the link FB after the change to the course information display processing unit 4. At this time, in a manner similar to the first exemplary embodiment, the obstacle figure calculating unit 2 associates the identification information of the combination of the links for each set of the sampling points on the ellipse and inputs the information to the course information display processing unit 4.

In a manner similar to the first exemplary embodiment, the course information display processing unit 4 displays the reference line 11 together with the x axis and the t axis in the display unit 5. The course information display processing unit 4 transforms the set of sampling points on the ellipse in the three-dimensional space calculated for each of the combinations of the links to the xt plane by using the transformation matrix Mi corresponding to the link of the aircraft of interest and displays the ellipse on the xt plane in the display unit 5. Those processes are similar to those of the first exemplary embodiment.

The course information display processing unit 4 changes the display mode of an ellipse between an ellipse on the xt plane obtained on the basis of a link of an aircraft in vicinity as in a flight plan and an ellipse on the xt plane obtained on the basis of a link of the aircraft in vicinity which is changed according to the FIX passing time change information.

Figure 7:
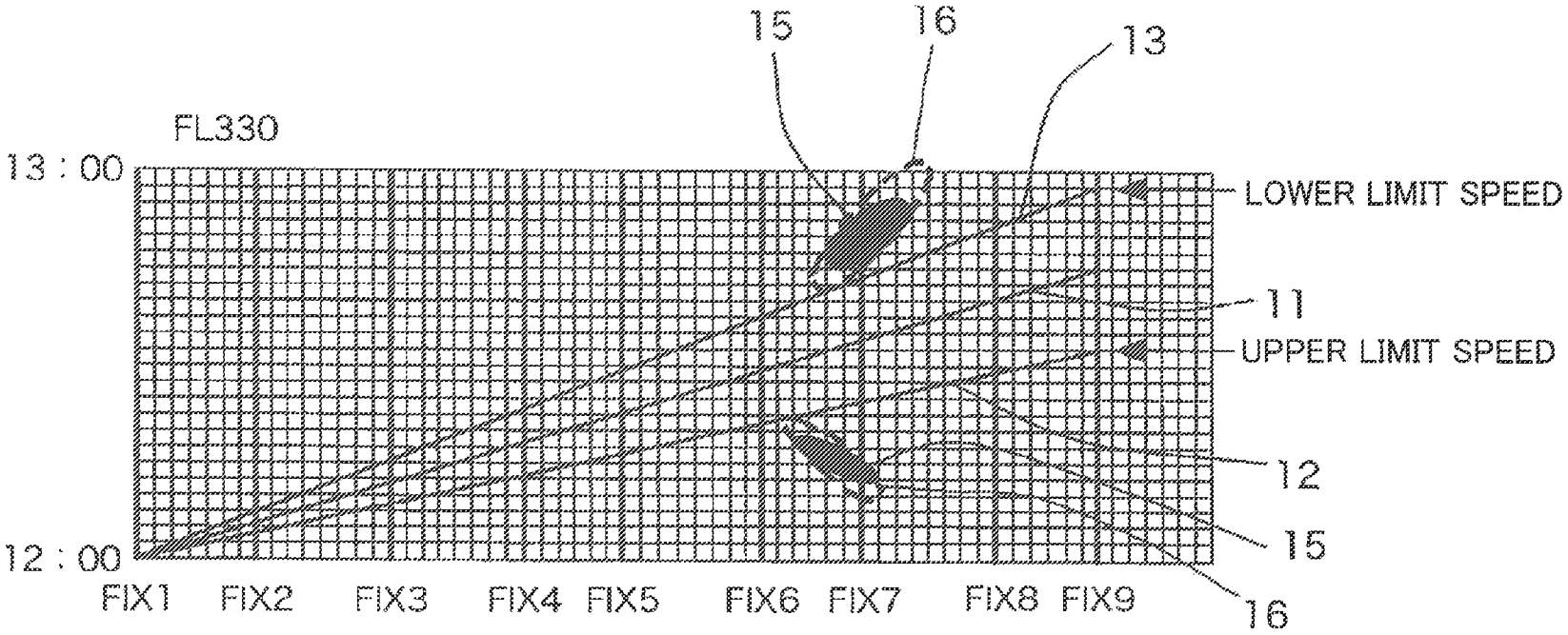
FIG. 7 is an explanatory diagram illustrating an example of an output screen of a second exemplary embodiment.

FIG. 7 is an explanatory diagram illustrating an example of an output screen of the second exemplary embodiment. In FIG. 7, the case of displaying the lines 12 and 13 as well is illustrated. The ellipse 15 illustrated in FIG. 7 is an ellipse on the xt plane obtained on the basis of a combination of the link of the aircraft in vicinity as in the flight plan and the link of the aircraft of interest in a manner similar to the first exemplary embodiment. An ellipse 16 illustrated in a display mode different from that of the ellipse 15 (specifically, the ellipse 16 displayed by dotted line) is an ellipse on the xt plane obtained on the basis of a combination of a link in the case of changing the FIX passing time of the aircraft in vicinity and the link of the aircraft of interest. In FIG. 7, an example of the case of delaying the end point time of the link of the aircraft in vicinity is displayed. In this case, the inclination of the ellipse 16 with respect to the x axis becomes larger than the ellipse 15, and the length of the ellipse 16 in the major axis direction becomes longer than that of the ellipse 15. The display modes of the ellipses 15 and 16 are not limited to the example illustrated in FIG. 7. For example, the course information display processing unit 4 may display the ellipses 15 and 16 so as to be discriminated by color density.

According to the exemplary embodiment, an effect similar to that of the first exemplary embodiment is obtained and the proximity state between an aircraft of interest and an aircraft in vicinity in the case where FIX passing time of the aircraft in vicinity changes can be also displayed in a mode that an air traffic controller can easily understand. For example, in the example illustrated in FIG. 7, by changing the FIX passing time of the aircraft in vicinity, the ellipse 16 comes closer to the reference line 11 than the ellipse 15. It is therefore understood that, when the state of the aircraft in vicinity changes as the air traffic controller designates, the reliability of the avoidance proposal selected by the air traffic controller decreases.

Third Exemplary Embodiment

An air traffic control assistance system of the third exemplary embodiment of the present invention can be expressed by a configuration similar to that of FIG. 2. Hereinbelow, referring to FIG. 2, the third exemplary embodiment will be described.

In the third exemplary embodiment, not only the avoidance proposal selected by an air traffic controller but also avoidance proposals generated by an external system and the like are input to the air traffic control assistance system 1. At this time, information of the present position of each of aircrafts of interest corresponding to each of the avoidance proposals is also input to the air traffic control assistance system 1.

When each of the avoidance proposals is input, the transformation matrix calculating unit 3 performs a process similar to that of the first exemplary embodiment (the process of step S1 illustrated in FIG. 6) for each avoidance proposal.

The obstacle figure calculating unit 2 performs a process similar to that in the first exemplary embodiment (the process of step S2 illustrated in FIG. 6) for each input avoidance proposal.

The course information display processing unit 4 displays a list of the avoidance proposals in the display unit 5. The course information display processing unit 4 varies the display modes of the avoidance proposals on the basis of reliability of each of the avoidance proposals.

The course information display processing unit 4 determines the reliability of each of the avoidance proposals on the basis of the number of ellipses displayed in the output screen (the graph in the xt plane exemplified in FIG. 1). The course information display processing unit 4 counts the number of ellipses in the case of displaying the output screen in the display unit 5 in a manner similar to the first exemplary embodiment for each avoidance proposal. In this case, the course information display processing unit 4 does not have to actually display the graph in the xt plane including the reference line 11 and the ellipse 15 (refer to FIG. 1). The size of the range displayed as the output screen (for example, length of the t axis or the like) is predetermined. It is sufficient for the course information display processing unit 4 to perform a process similar to step S3 illustrated in FIG. 6 (the process of transforming an ellipse to the xt plane) for each input avoidance proposal and count the number of ellipses displayed in the determined range for each avoidance proposal. The course information display processing unit 4 displays the list of avoidance proposals in the display unit 5 by displaying each of the avoidance proposals in a display mode according to the count result in the display unit 5.

Figure 8:
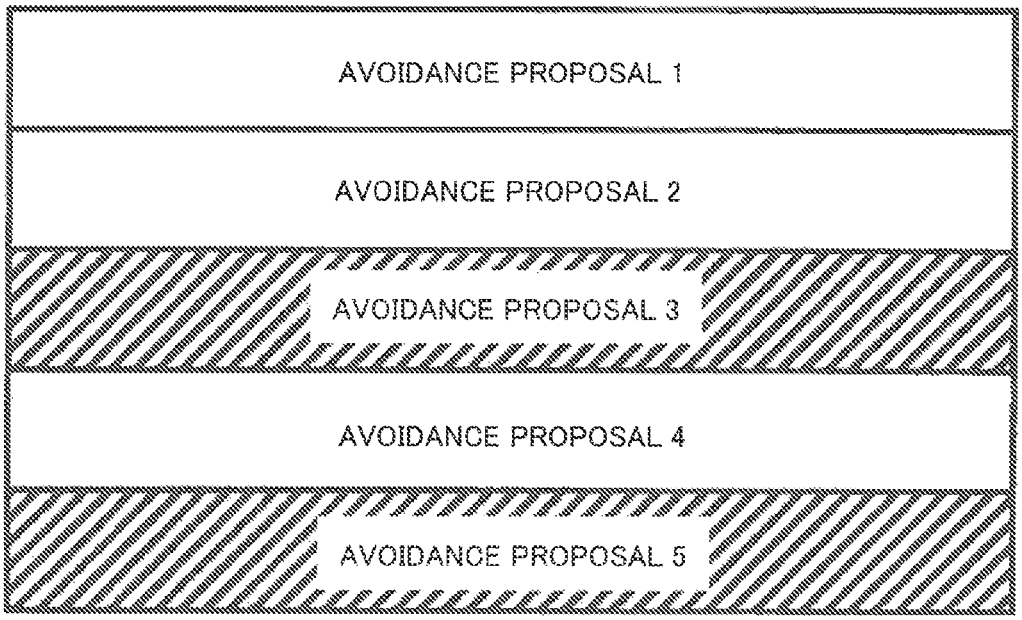
FIG. 8 is a schematic diagram illustrating a display example of a list of avoidance plans.

The course information display processing unit 4 may display avoidance proposals in different colors in accordance with the count results of the ellipses. For example, the course information display processing unit 4 may display the avoidance proposals in different colors such as red in the case where the count result of ellipses is equal to or less than q and blue in the case where the count result is equal to or larger than q+1. In the case of varying the display modes of the avoidance proposals in accordance with the count result of ellipses, the display mode of an avoidance proposal may be varied in a method other than the method of using different colors. FIG. 8 is a schematic diagram illustrating a display example of a list of avoidance proposals. FIG. 8 illustrates a case where when the count result of ellipses is equal to or less than q, an avoidance proposal is displayed using white as a background color and when the count result is equal to or larger than q+1, an avoidance proposal is displayed using hatched lines as a background. Although the case of using different modes for the case where the count result of ellipses is equal to or less than q and the case where the count result of ellipses is equal to or larger than q+1 has been described as an example, the display modes of avoidance proposals may be classified more finely.

When the count result of ellipses is small, it means that the number of aircraft in vicinity which will come close in the future is small. Therefore, an air traffic controller can select an avoidance proposal having higher reliability from a plurality of avoidance proposals in accordance with the display modes of the avoidance proposals. For example, in the example illustrated in FIG. 8, an air traffic controller can determine that reliability of avoidance proposals 1, 2, and 4 is higher than that of avoidance proposals 3 and 5.

In FIG. 8, avoidance proposals are schematically illustrated. In practice, as each avoidance proposal, for example, the ID of an avoidance proposal, the ID of an aircraft as a target of a state change, the details of the state change (details of a change in speed or altitude), information of start and end time of a change, and the like are displayed.

When the avoidance proposal selected by the air traffic controller is input, it is sufficient for the air traffic control assistance system 1 to execute processes (steps S1 to S4) similar to those of the first exemplary embodiment at that time point. Alternatively, the second exemplary embodiment may be applied.

According to the third exemplary embodiment, a list of avoidance proposals of a conflict detected in advance can be presented to an air traffic controller in a mode that the reliability of each of the avoidance proposals can be easily understood.

Figure 9:
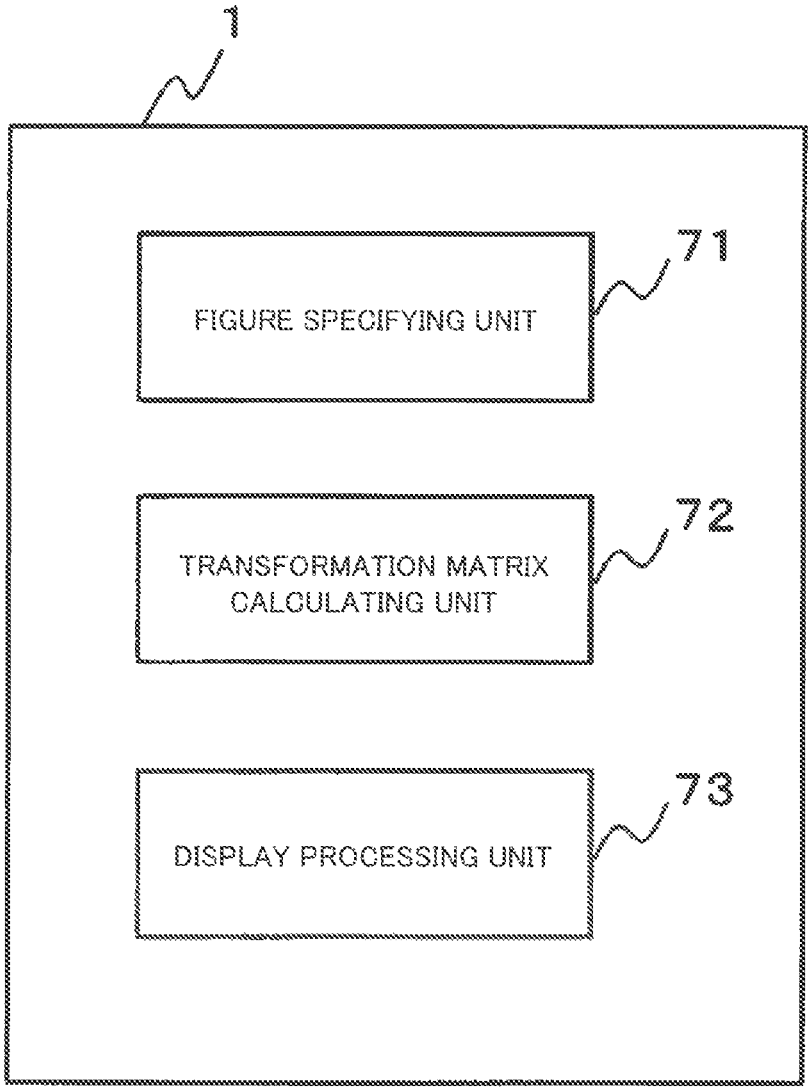
FIG. 9 is a block diagram illustrating main components of the present invention.

Next, main components of the present invention will be described. FIG. 9 is a block diagram illustrating main components of the present invention. The air traffic control assistance system 1 of the present invention has a figure specifying unit 71, a transformation matrix calculating unit 72, and a display processing unit 73.

The figure specifying unit 71 (for example, the obstacle figure calculating unit 2) determines, as a set of interval information (for example, links) between passing points of a moving object (for example, aircraft) expressed by a set of three-dimensional coordinates using, as coordinate values, an x coordinate and a y coordinate of a passing point (for example, FIX) determined as a position where the moving object passes and passing time of the moving object, a set of interval information of the aircraft of interest as one of moving objects in the case where the state of the aircraft of interest as a target of a state change by an avoidance proposal for a near miss between the moving objects is changed on the basis of the avoidance proposal and interval information of an aircraft in vicinity as one of the moving objects other than the aircraft of interest, and specifies a figure (for example, the ellipse "d") expressing a predetermined range defined by the aircraft in vicinity in a plane (for example, the plane $H_0$) including a three-dimensional vector expressed by the interval information of the aircraft of interest and perpendicular to an xy plane for each of sets of the interval information of the aircraft of interest and the interval information of the aircraft in vicinity.

The transformation matrix calculating unit 72 (for example, the transformation matrix calculating unit 3) calculates, for each two-dimensional vector, a transformation matrix (for example, transformation matrix Mi) expressing a transformation from a plane including the two-dimensional vector and perpendicular to the xy plane to a plane defined by the x axis and the time axis in the case of transforming two-dimensional vectors in the xy plane extending from a passing point of the aircraft of interest toward the next passing point so as to be arranged in order along the x axis.

The display processing unit 73 (for example, the course information display processing unit 4) applies a transformation matrix corresponding to the interval information of the aircraft of interest used to specify the figure to the figure specified by the figure specifying unit 71, thereby transforming the figure to the plane defined by the x axis and the time axis, and displays a line (for example, the reference line 11) connecting points each determined by a passing point and time when the aircraft of interest passes through the passing point and the transformed figure together with the x axis and the time axis.

With such a configuration, the reliability of the avoidance proposal at present and in the future can be displayed in a mode that an air traffic controller can easily understand.

The figure specifying unit 71 may determine, when information of passing time of an aircraft in vicinity included in the interval information of the aircraft in vicinity is changed, a set of the interval information of the aircraft of interest and the interval information of an aircraft in vicinity after the change and, for each determined set, specify a figure expressing a predetermined range defined by the aircraft in vicinity. The display processing unit 73 may transform, by applying a transformation matrix corresponding to the interval information of the aircraft of interest used to specify the figure to the figure, the figure to the plane defined by the x axis and the time axis and displays the transformed figure.

In the case where a list of avoidance proposals for a near miss between moving objects is input, the figure specifying unit 71 may determine a set of the interval information of the aircraft of interest and the interval information of an aircraft in vicinity for each of aircrafts of interest corresponding to each of the avoidance proposals and specify figures expressing the predetermined range defined by each of the aircrafts in vicinity for each determined set. The transformation matrix calculating unit 72 may calculate transformation matrices for each of the aircrafts of interest corresponding to each of the avoidance proposals. The display processing unit 73 may transform, by applying the transformation matrices corresponding to the interval information of the aircrafts of interest used to specify the figures to the figures specified by the figure specifying means for each of the aircrafts of interest corresponding to each of the avoidance proposals, the figures to the plane defined by the x axis and the time axis and displays a list of the avoidance proposals while varying display modes of the avoidance proposals in accordance with the number of the figures existing in a predetermined range in the plane.

The figure specifying unit 71 may specify the figure corresponding to an intersection part between a column body (for example, the oblique column body H1) defined by moving a circle parallel to the xy plane and whose radius is a constant (for example, oceanic air traffic control separation) along a three-dimensional vector expressed by interval information of the aircraft in vicinity and a plane including the three-dimensional vector expressed by the interval information of the aircraft of interest and perpendicular to the xy plane.

The figure specifying unit 71 may calculate time when the aircraft of interest passes through a passing point in the case of travelling at a upper limit speed and time when the aircraft of interest passes through a passing point in the case of travelling at a lower limit speed. The display processing unit 73 may display a line (for example, the line 12) connecting points each determined by the passing point and time when the aircraft of interest passes through the passing point in the case of traveling at the upper limit speed and a line (for example, the line 13) connecting points each determined by a passing point and time when the aircraft of interest passes through the passing point in the case of travelling at the lower limit speed.

The present application claims for priority based on Japanese Patent Application No. 2013-072179 filed on Mar. 29, 2013 and all of the disclosure is incorporated herein.

Although the present invention has been described above with reference to the exemplary embodiments, the present invention is not limited to the foregoing exemplary embodiments. Various changes which can be understood by a person skilled in the art can be made to the configuration and details of the present invention within the scope of the present invention.

INDUSTRIAL APPLICABILITY

The present invention is preferably applied to an air traffic control assistance system which makes an air traffic controller determine reliability of a conflict avoidance proposal more easily.

REFERENCE SIGNS LIST

1 Air traffic control assistance system
2 Obstacle figure calculating unit
3 link-including-plane transformation matrix calculating unit
4 course information display processing unit
5 display unit

The invention claimed is:

1. An air traffic control assistance system comprising:

a figure specifying unit including a processor which determines, as a set of interval information between passing points of a moving object expressed by a set of three-dimensional coordinates using, as coordinate values, an x coordinate and a y coordinate of a passing point determined as a position where the moving object passes and passing time of the moving object, a set of interval information of an aircraft of interest as one of moving objects when a state of the aircraft of interest as a moving object as a target of a state change by an avoidance proposal for a near miss between the moving objects is changed based on the avoidance proposal and interval information of an aircraft in vicinity as one of the moving objects other than the aircraft of interest, and specifies a figure expressing a predetermined range defined by the aircraft in vicinity in a plane including a three-dimensional vector expressed by the interval information of the aircraft of interest and perpendicular to an xy plane for each of sets of the interval information of the aircraft of interest and the interval information of the aircraft in vicinity;

a transformation matrix calculating unit including the processor, which calculates, for each two-dimensional vector, a transformation matrix expressing a transformation from a plane including the two-dimensional vector and perpendicular to the xy plane to a plane defined by an x axis and a time axis when transforming two-dimensional vectors in the xy plane extending from a passing point of the aircraft of interest toward a next passing point so as to be arranged in order along the x axis; and a display processing unit including the processor which applies, to the figure specified by the figure specifying unit, the transformation matrix corresponding to the interval information of the aircraft of interest used to specify the figure, transforms the figure to the plane defined by the x axis and the time axis, and displays a line connecting points each determined by a passing point and time when the aircraft of interest passes through the passing point and the transformed figure together with the x axis and the time axis, wherein the figure specifying unit determines, when a list of avoidance proposals for the near miss between the moving objects is inputted, a set of the interval information of the aircraft of interest and the interval information of the aircraft in vicinity for each of aircrafts of interest corresponding to each of the avoidance proposals, and figures expressing the predetermined range defined by each of a plurality of aircrafts in vicinity for each determined set of the interval information are specified, the transformation matrix calculating unit calculates transformation matrices for each of the aircrafts of interest corresponding to each of the avoidance proposals, and the display processing unit, by applying the transformation matrices corresponding to the interval information of the aircrafts of interest used to specify figures to the figures specified by the figure specifying unit for each of the aircrafts of interest corresponding to each of the avoidance proposals, transforms the figures to the plane defined by the x axis and the time axis and displays the list of the avoidance proposals while varying display modes of the avoidance proposals in accordance with a number of the figures existing in the predetermined range in the plane.

2. The air traffic control assistance system according to claim 1, wherein the figure specifying unit specifies the figure corresponding to an intersection part between a column body defined by moving a circle parallel to the xy plane and whose radius is a constant along the three-dimensional vector expressed by the interval information of the aircraft in vicinity and the plane including the three-dimensional vector expressed by the interval information of the aircraft of interest and perpendicular to the xy plane.

3. The air traffic control assistance system according to claim 1, wherein the figure specifying unit calculates time when the aircraft of interest passes through the passing point when travelling at a upper limit speed and time when the aircraft of interest passes through the passing point when travelling at a lower limit speed, and the display processing unit displays a line connecting points each determined by the passing point and time when the aircraft of interest passes through the passing point when traveling at the upper limit speed and a line connecting points each determined by the passing point and time when the aircraft of interest passes through the passing point when travelling at the lower limit value.

4. An air traffic control assistance method, the method comprising:

determining, by a processor, as a set of interval information between passing points of a moving object expressed by a set of three-dimensional coordinates using, as coordinate values, an x coordinate and a y coordinate of a passing point determined as a position where the moving object passes and passing time of the moving object, a set of interval information of an aircraft of interest when the state of the aircraft of interest as a moving object as a target of a state change by an avoidance proposal for a near miss between moving objects is changed based on the avoidance proposal and interval information of an aircraft in vicinity as one of the moving objects other than the aircraft of interest, and specifying a figure expressing a predetermined range defined by the aircraft in vicinity in a plane including a three-dimensional vector expressed by the interval information of the aircraft of interest and perpendicular to an xy plane for each of sets of the interval information of the aircraft of interest and the interval information of the aircraft in vicinity;

calculating, by the processor, for each two-dimensional vector, a transformation matrix expressing a transformation from a plane including the two-dimensional vector and perpendicular to the xy plane to a plane defined an x axis and a time axis when transforming two-dimensional vectors in the xy plane extending from a passing point of the aircraft of interest toward a next passing point so as to be arranged in order along the x axis;

applying, by the processor, to the specified figure, the transformation matrix corresponding to the interval information of the aircraft of interest used to specify the figure, thereby transforming the figure to the plane defined by the x axis and the time axis, and displaying a line connecting points each determined by a passing point and time when the aircraft of interest passes through the passing point and the transformed figure together with the x axis and the time axis;

determining, by the processor, when a list of avoidance proposals for the near miss between the moving objects is inputted, a set of the interval information of the aircraft of interest and the interval information of an aircraft in vicinity for each of aircrafts of interest corresponding to each of the avoidance proposals, and figures expressing the predetermined range defined by each of a plurality of aircrafts in vicinity for each determined set of the interval information are specified;

calculating, by the processor, transformation matrices for each of the aircrafts of interest corresponding to each of the avoidance proposals; and by applying the transformation matrices corresponding to the interval information of the aircrafts of interest used to specify figures to the figures specified by the figure specifying unit for each of the aircrafts of interest corresponding to each of the avoidance proposals, transforming, by the processor, the figures to the plane defined by the x axis and the time axis and displays the list of the avoidance proposals while varying display modes of the avoidance proposals in accordance with a number of the figures existing in the predetermined range in the plane.

5. A non-transitory readable storage medium containing instructions, that when executed by a processor, cause the processor to execute a method, the method comprising:

determining, as a set of interval information between passing points of a moving object expressed by a set of three-dimensional coordinates using, as coordinate values, an x coordinate and a y coordinate of a passing point determined as a position where the moving object passes and passing time of the moving object, a set of interval information of an aircraft of interest as one of moving objects when the state of the aircraft of interest as a moving object as a target of a state change by an avoidance proposal for a near miss between the moving objects is changed based on the avoidance proposal and interval information of an aircraft in vicinity as one of the moving objects other than the aircraft of interest, and specifies a figure expressing a predetermined range defined by the aircraft in vicinity in a plane including a three-dimensional vector expressed by the interval information of the aircraft of interest and perpendicular to an xy plane for each of sets of the interval information of the aircraft of interest and the interval information of the aircraft in vicinity;

calculating, for each two-dimensional vector, a transformation matrix expressing a transformation from a plane including the two-dimensional vector and perpendicular to the xy plane to a plane defined by an x axis and a time axis when transforming two-dimensional vectors in the xy plane extending from a passing point of the aircraft of interest toward a next passing point so as to be arranged in order along the x axis;

applying, to the figure specified by the figure specifying process, the transformation matrix corresponding to the interval information of the aircraft of interest used to specify the figure, transforms the figure to the plane defined by the x axis and the time axis, and displays a line connecting points each determined by a passing point and time when the aircraft of interest passes through the passing point and the transformed figure together with the x axis and the time axis;

determining when a list of avoidance proposals for the near miss between the moving objects is inputted, a set of the interval information of the aircraft of interest and the interval information of an aircraft in vicinity for each of aircrafts of interest corresponding to each of the avoidance proposals, and figures expressing the predetermined range defined by each of a plurality of aircrafts in vicinity for each determined set of the interval information are specified;

calculating transformation matrices for each of the aircrafts of interest corresponding to each of the avoidance proposals; and by applying the transformation matrices corresponding to the interval information of the aircrafts of interest used to specify figures to the figures specified by the figure specifying unit for each of the aircrafts of interest corresponding to each of the avoidance proposals, transforming the figures to the plane defined by the x axis and the time axis and displays the list of the avoidance proposals while varying display modes of the avoidance proposals in accordance with a number of the figures existing in the predetermined range in the plane.

* * * * *